US005678144A

United States Patent [19]

Osaki et al.

[11] Patent Number: 5,678,144

[45] Date of Patent: Oct. 14, 1997

[54] IMAGE FORMING APPARATUS HAVING A ROTATIONAL INFORMATION DETECTOR FOR A PHOTORECEPTOR

[75] Inventors: Hajime Osaki; Isao Matsuoka, both of Hachioji, Japan

[73] Assignee: Konica Corporation, Tokyo, Japan

[21] Appl. No.: 539,777

[22] Filed: Oct. 5, 1995

[30] Foreign Application Priority Data

| | | | |
|---|---|---|---|
| Oct. 11, 1994 | [JP] | Japan | 6-245420 |
| Oct. 14, 1994 | [JP] | Japan | 6-249728 |
| Oct. 14, 1994 | [JP] | Japan | 6-249729 |
| Oct. 17, 1994 | [JP] | Japan | 6-250695 |

[51] Int. Cl.[6] ..... G03G 15/00

[52] U.S. Cl. ..... 399/167; 399/159

[58] Field of Search ..... 355/211, 212, 355/213, 208, 203, 204, 277; 399/159, 167

[56] References Cited

U.S. PATENT DOCUMENTS

| | | | |
|---|---|---|---|
| 4,671,645 | 6/1987 | Saito et al. | 399/167 |
| 4,739,230 | 4/1988 | Sonobe et al. | 388/812 |
| 5,076,568 | 12/1991 | Jong et al. | 271/275 |
| 5,132,728 | 7/1992 | Suzaki et al. | 399/167 |
| 5,235,392 | 8/1993 | Hediger | 399/76 |
| 5,241,400 | 8/1993 | Itagaki | 358/401 |
| 5,313,254 | 5/1994 | Temple | 399/78 |
| 5,325,155 | 6/1994 | Perry | 399/167 |
| 5,502,544 | 3/1996 | Carolan | 399/46 |

FOREIGN PATENT DOCUMENTS

| | | |
|---|---|---|
| 2-304576 | 12/1990 | Japan . |
| 6-186239 | 7/1994 | Japan . |
| 7-129034 | 5/1995 | Japan . |

*Primary Examiner*—Matthew S. Smith

*Attorney, Agent, or Firm*—Frishauf, Holtz, Goodman, Langer & Chick

[57] ABSTRACT

An image forming apparatus includes a rotational body having a rotation shaft, marks provided on a circumferential surface of the rotational body at a predetermined positional interval each other, a rotational photoreceptor provided on the rotation shaft, a driving system to drive the photoreceptor, a light source to emit a light onto the marks, a line sensor having a plurality of pixels in a row in which each pixel outputs an electric signal in accordance with a light intensity of the light projected, an image formation lens to focus the light reflected from the marks onto the plurality of pixels of the line sensor, a detector to detect a rotational information of the photoreceptor on the basis of the electric signal obtained by the line sensor. The apparatus further includes a control circuit to control the drive system on the basis of the rotational information detected by the detector to control a rotation of the photoreceptor.

26 Claims, 16 Drawing Sheets

FIG. 2
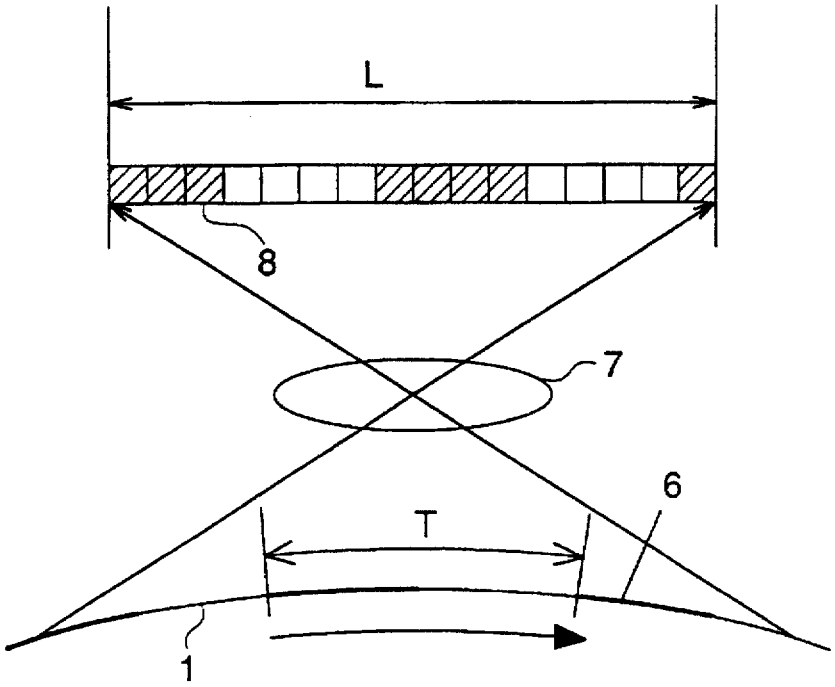
FIG. 3 (a)
FIG. 3 (b)
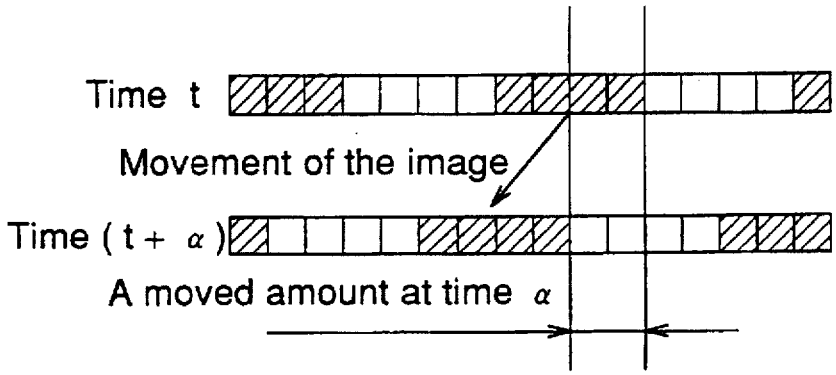

FIG. 12 ( a )
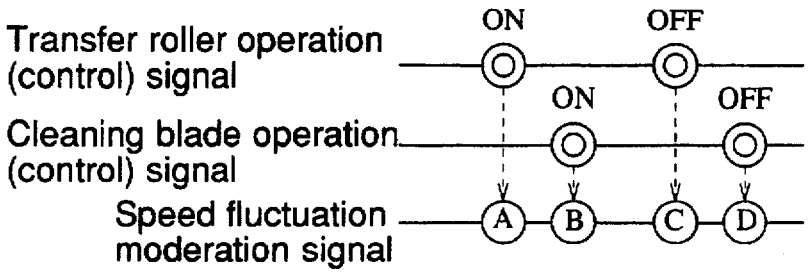
FIG. 12 ( b-1 )
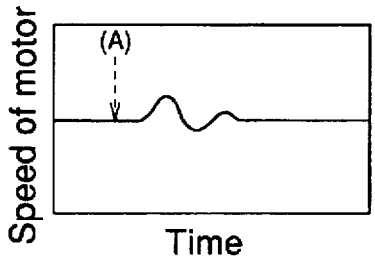
FIG. 12 ( b-3 )
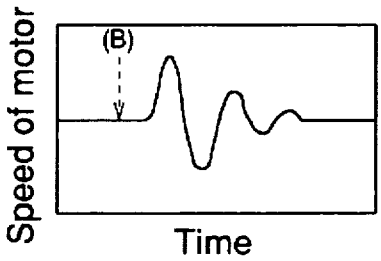
FIG. 12 ( b-2 )
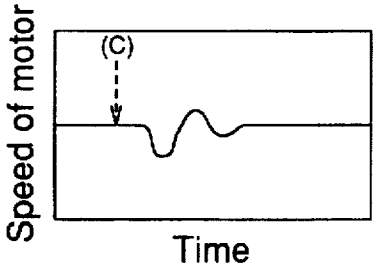
FIG. 12 ( b-4 )
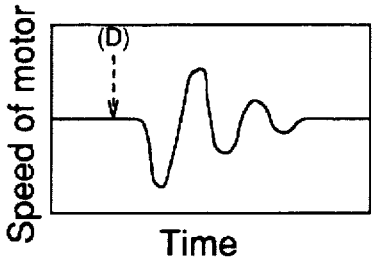
FIG. 12 ( c-1 )
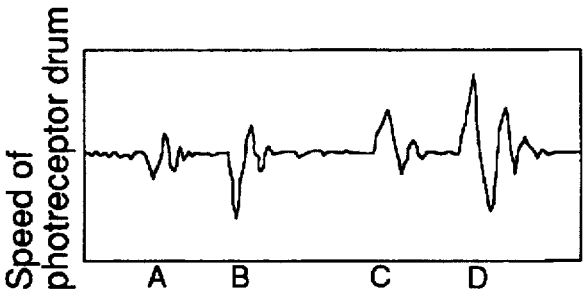
FIG. 12 ( c-2 )
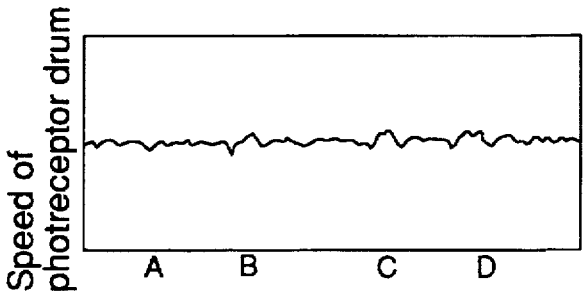

FIG. 18 ( a )
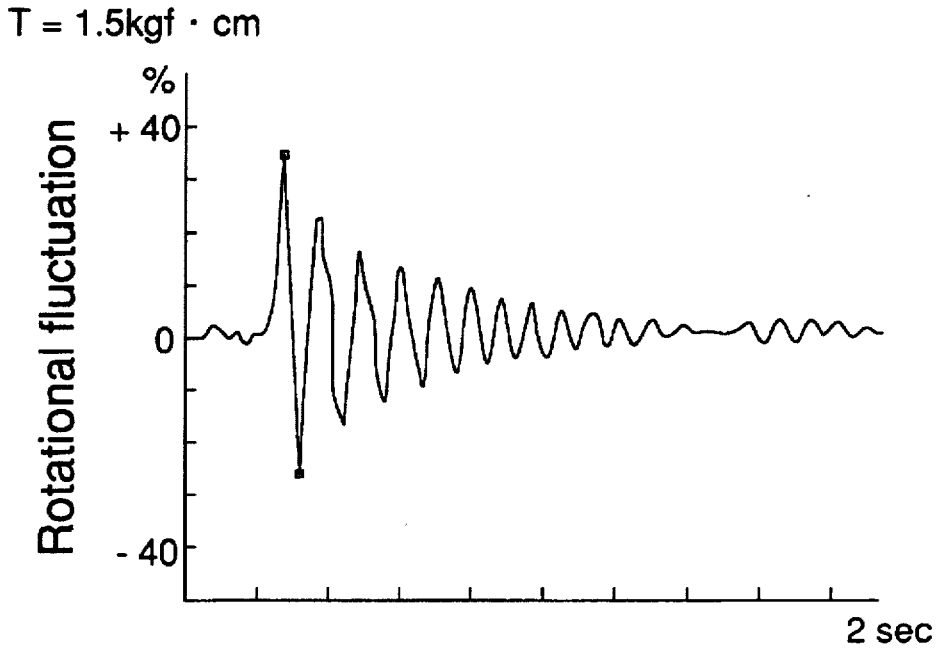
FIG. 18 ( b )
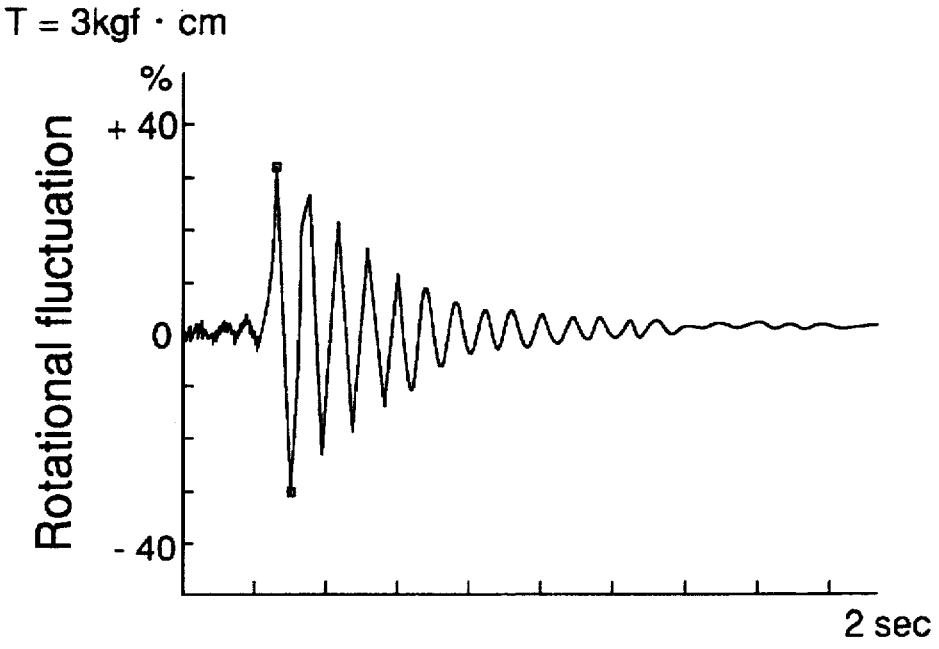

IMAGE FORMING APPARATUS HAVING A ROTATIONAL INFORMATION DETECTOR FOR A PHOTORECEPTOR

BACKGROUND OF THE INVENTION

The present invention relates to an image forming apparatus such as an electrophotographic apparatus, a printing apparatus, or the like, in which an image is reproduced on a transfer sheet by image information, and specifically relates to an image forming apparatus provided with a detector to detect rotational information of a photoreceptor for forming an image.

In the field of an image forming apparatus such as an electrophotographic apparatus or a printing apparatus, the following method is conventionally employed. A latent image is formed on the photoreceptor by an electrical potential difference, and the latent image is developed by a developer so that a developer image is formed. As an example, an electrophotographic apparatus will be described below, referring to the accompanying drawings.

In FIG. 4, an automatic document feeding section 11 is located on the upper surface of an image forming apparatus main body 10. The automatic document feeding section 11 automatically feeds a sheet of document to a reading position. Numeral 12 is a reading section, in which image information of the document fed to the reading position is read by light receiving elements such as CCDs, or the like, and an image signal is outputted as an analog signal. Numeral 13 is a processing circuit section including an analog/digital conversion section, an image processing section, and a video interface section. The analog image signal outputted from the reading section 12 is analog/digital-converted into a digital signal, and the image signal, digitized in the image processing section and the video interface section, is converted into a signal appropriate for image recording. Numeral 14 a laser writing section including a laser optical system in which laser beams are emitted by the recording signal. Optical scanning is conducted on a rotating photoreceptor drum 15*a*, and a latent image is formed. An image forming section composed of the photoreceptor drum 15*a*, and a charger, developing units, etc., provided around the photoreceptor drum, develops the latent image with toners, Which are developing material, into a toner image. The toner image is transferred onto a transfer sheet, fed from sheet feed sections 16*a* and 16*b*. This transfer sheet is conveyed to a fixing unit 17, while retaining the transferred toner image thereon, and then fixed by the fixing unit. The transfer sheet, on which the toner image has been fixed and recorded, is delivered from a sheet delivery section 18.

In the image forming apparatus structured as described above, the synchronization of the rotation of a photoreceptor drum with the optical scanning operation, or the synchronization of the rotation of the photoreceptor drum with the development by developing units, largely affects the image quality of the image, finally formed on the transfer sheet. That is, the rotational accuracy of the photoreceptor drum directly affects the quality of the image. This is the same as in the case where a belt-like photoreceptor is used, in the point of view in which the rotational accuracy of the rotational body for driving the belt affects the quality of the image. Therefore, it is desirable to introduce a method for keeping the rotation of the rotational body constant, which drives a photoreceptor drum or a belt-shaped photoreceptor.

There are two means for increasing the rotational accuracy of the photoreceptor in this conventional technological field, when technological means are roughly classified. The first means includes a certain structure by which the photoreceptor rotates under physically stable conditions. The first means is structured as follows. Rotational fluctuations are decreased when a flywheel is attached to the photoreceptor so that its inertial force is increased. The second means is structured as follows. The rotation of the photoreceptor is actively controlled when rotation information of the photoreceptor is detected by a detector, and a drive source for driving the photoreceptor is controlled according to the detected information. This is called "active control". The first means can be relatively easily employed. However, it is nearly impossible to conduct the minute rotation control of the photoreceptor by the means such as the second means. Further, a mechanical load is given onto the drive system when the flywheel is attached to the photoreceptor, and therefore, a larger output drive system is necessary, resulting in an increase of the size of the whole image forming apparatus. Accordingly, in order to realize an image forming apparatus, the size of which is more compact, by which the excellent image quality can be obtained, it is absolutely necessary to conduct the rotation control of the photoreceptor by the active control, which is the second means.

In order to control the rotation of the photoreceptor by the active control, it is considered to detect rotation information of the photoreceptor by a conventional encoder in which a point-sensor is used. The structure of this encoder will be explained below, referring to the accompanying drawings.

In FIG. 5, a mark M is provided on the surface of a rotational body R at a predetermined pitch. A light beam is emitted from a light source S onto the surface of the rotating rotational body at a predetermined angle. The emitted light beam is reflected from the surface of the rotational body R, and the reflected light beam is received by a fixed optical sensor D. The optical sensor D generates an electric signal corresponding to the intensity of the reflected light received, as detailed above. At this time, the light beam emitted from the light source S is apt to be absorbed at the portion of mark M provided on the surface of the rotational body R. Accordingly, the electric signal sent from the optical sensor D has a low voltage as shown by $t_2$ in FIG. 6. At non-marked portions on the surface of the rotational body R, the electric signal has a high voltage as shown by $t_1$ in FIG. 6. Accordingly, as a result, the electric signal sent from the optical sensor D has a wave form as shown in FIG. 6.

In the encoder structured as above, the accuracy of the output signal from the encoder is determined depending on the relationship between the peripheral length of the rotational body in the encoder, and the pitch of the marks provided on the rotational body. That is, the accuracy of the output signal from the encoder is increased when the size of the rotational body is increased, or the pitch of the marks is finer and more accurate. However, when an encoder is used for an image forming apparatus, the size of a rotational body is inevitably limited by the size of the apparatus main body, and therefore, it is necessary to reduce further the pitch of the marks. The excellent image quality, which is desired by the applicant in the image forming apparatus, is approximately 300 DPI–400 DPI in the number of pixels in the resolving power of a color image, which is desired to be appropriately reproduced. This resolving power corresponds to the length of 84.7 μm–63.5 μm per each pixel. If fluctuation of more than 5% of the length of one pixel occurs in the image to be reproduced, the desired image quality can not be attained. That is, in order to obtain the excellent image quality, it is necessary to detect fluctuation of approximately 3μm, at the minimum, of the position on the photoreceptor, in the accuracy of the encoder. Accordingly, it is required to obtain the print interval of approximately 10 μm–50 μm and the width of the mark having the dimensional error not more than 1%, in the marks on the rotational body of the encoder. Such a encoder is very expensive, and it is, practically, nearly impossible to install it into the image forming apparatus.

In this connection, the encoder described above is a means to detect the rotational speed of the rotational body. Actually, however, in order to control the rotation of the photoreceptor of the image forming apparatus, it is necessary to control the drive system of the photoreceptor by computing the rotational speed at one time from obtained position information of the rotational body, and further by computing the fluctuation of its rotational speed. Accordingly, a processing means for computing rotation information from position information obtained from the encoder, and a processing means for further computation-processing the rotation information, and for obtaining rotation acceleration information, are necessary for the rotation control of the photoreceptor. When it takes a long period of time for processing, a time difference occurs between the fluctuation of the rotational speed and the corresponding processing, and therefore, it is difficult to control the rotation of the photoreceptor at real time.

The inventors of the present invention noticed the following. The method to directly detect the rotational speed or fluctuation of the rotational speed (that is, rotation acceleration) of the rotational body, is more rational than the conventional method to detect fluctuation of rotation of the photoreceptor, for the rotation control of the photoreceptor of the image processing apparatus. Then, the inventors have investigated the application of the detection means, which can directly detect the speed or acceleration, to the image processing apparatus. As a result, the following has been noticed. There is a mechanical means, which is called a gyroscope, to simultaneously detect the movement direction and the acceleration; a means, which is called an impact sensor, to detect a transient impact; and a means, which is called a pressure sensor, to detect changes of the atmospheric pressure, air quantity, and water level, as conventional detection means to detect the speed or the acceleration, which are used in an entirely different field, and can apply to the image processing apparatus. Conventionally, the gyroscope is used in a navigation system of vehicles, camera-shake prevention of VTR cameras, etc., and is mainly used for detecting the movement direction of the apparatus in which the gyroscope is installed. The impact sensor is used for detecting the impact, applied onto a hard disk drive from the outside of the apparatus, or it is applied for a safety measure of vehicles, and is used for detecting a transient impact, applied onto the apparatus in which the impact sensor is installed. The pressure sensor is used for detecting the intake pressure in vehicles, the air quantity, water level or the like, in domestic electric apparatus. However, these detection means are not yet applied for detecting the rotation acceleration of a rotational body, such as a photoreceptor of the image forming apparatus, which rotates in one direction. In the application of these detection means to the entirely different field, there is no consideration about the specification of the product, to which the detection means is applied, when the detection means is designed. Accordingly, it is very difficult to discover the detection means with which the specification of the apparatus matches perfectly.

On the other hand, in the commercial image forming apparatus, such as a transfer apparatus, a printer, etc., it is desired that the size be small and compact, and high speed processing can be carried out. Therefore, the interval formed between processing means provided near the photoreceptor, is decreased, and the drum-shaped photoreceptor, the diameter of which is relatively small, is preferably used as the photoreceptor.

A charging means, an image exposure means, a developing means, a transfer means and a cleaning means are provided near the photoreceptor drum. A latent image is formed by the image exposure means on the photoreceptor drum, which has been uniformly charged by the charging means. The latent image is developed into a toner image by the developing means, and then, the toner image is transferred onto a transfer sheet by the transfer means. Toners, remaining on the photoreceptor drum after transfer, are removed by the cleaning means, and the photoreceptor drum is made ready for the next image formation. In an image forming apparatus, in which a plurality of developing means are provided around the photoreceptor drum and an image is transferred onto the transfer sheet after multi-color toner images have been superimposed on the photoreceptor drum, a transfer roller or a transfer belt is used as the transfer means. During transferring, the transfer operation is preferably conducted by impressing an electric charge having a reverse polarity to that of toner, onto the transfer sheet from the rear of the sheet while the transfer sheet is being pressed onto the photoreceptor drum by the transfer roller or the transfer belt. As a cleaning means, an elastic blade member is used. The cleaning means is slidably contacted with the peripheral surface of the photoreceptor drum, and the residual toner is removed by the cleaning means. In the image forming apparatus, in which an image is formed by superimposing multi-color images on the photoreceptor drum, specifically in the image forming apparatus in which an image is formed by superimposing multi-color images on the photoreceptor drum while the photoreceptor drum is rotating, it is not allowed that the transfer means and the cleaning means are in continuous contact with the photoreceptor drum. Accordingly, it is necessary that these means are in pressure contact with the photoreceptor drum, and are released from the pressure contact, during the image forming process. Operations of the transfer means is controlled as follows. The transfer means is in pressure contact with the peripheral surface of the photoreceptor drum while an image is transferred onto the transfer sheet, and the transfer means is separated from the peripheral surface of the photoreceptor drum (release from the contact-pressure) during other image forming processes. Operations of the cleaning means is controlled as follows. The cleaning means is in pressure contact with the peripheral surface of the photoreceptor drum during cleaning operations, and are released from the pressure contact during other image forming processes.

When the cleaning means or the transfer means comes into pressure contact with the photoreceptor drum, or released from the pressure contact, a load fluctuation is caused with respect to the photoreceptor drum, resulting in rotational speed fluctuations. When the pressure-contact or the release from the pressure-contact is conducted during the image forming process, specifically, during the latent image formation by a digital image exposure means, the pitch fluctuation occurs on the image, resulting in a decrease of the image quality. Further, in the image forming process in which the image is formed by superimposing the multi-color images on the photoreceptor drum, color slippage occurs on the image, resulting in an unacceptable decrease of the image quality.

Further, the present invention relates to a driving apparatus of the photoreceptor, used in an electrophotographic copier or the like, and specifically to a driving apparatus of the photoreceptor, provided with an active control means for the rotational speed of the photoreceptor.

It is assured that an image is formed with complete fidelity to a document when a photoreceptor drum or a photoreceptor belt, used for an electrophotographic copier or the like, is driven at an uniformly constant speed, and an image exposure is conducted on the photoreceptor, also driven at a constant speed. Because it is difficult to eliminate the rotational fluctuation caused by load fluctuations due to the pressure contact or the release from the pressure contact of the transfer roller and the cleaning member with the photoreceptor during image formation, a method is employed in which a control resistance due to a brake means is previously added onto the photoreceptor drum in order to reduce the rotational fluctuations. This method is applied for keeping the rotation of a drive motor constant, and for example, it is applied as a countermeasure so that the speed of the photoreceptor is not increased when, for example, the load is released.

Further, the following active rotation control method is also employed. A program in which the occurrence of load fluctuation is predicted, is previously installed into the apparatus. Any fluctuation of the speed of the photoreceptor drum is detected by a rotary encoder or the like, and the drive speed of the drive motor to drive the photoreceptor drum is controlled almost instantaneously by the detected information, and the fluctuation of the rotational speed of the drum is eliminated in advance.

However, in many cases, the photoreceptor drum is driven by the drive motor through a gear train. Accordingly, when load fluctuations occur on the photoreceptor drum, or the rotational speed of the motor is changed, transmission of the drive power is discontinuous due to the backlash of the gear train, and rotational fluctuation occurs to the photoreceptor drum. This phenomena can not be avoided even when the rotational speed of the photoreceptor drum is controlled by the active control, and specifically, an instantaneous time lag occurs when the drive speed is decreased, resulting in decreased control performance.

SUMMARY OF THE INVENTION

The first object of the present invention is to obtain an image forming apparatus in which a rotation information detector, which has the accuracy applicable to stable rotation of the photoreceptor, and which can be realized at low cost, is installed, and thereby, an image of high quality can be formed.

The second object of the present invention is to actively control the rotation of the photoreceptor by attaching an acceleration detection means, represented by the above-described impact sensor, which is a rotation information detector, to the photoreceptor of the image forming apparatus, and by detecting the rotational speed or changes of the rotational speed of the photoreceptor from an electric signal obtained from the detection means.

The third object of the present invention is to provide an image forming apparatus in which an image, having no pitch fluctuation and high quality, is obtained by decreasing the rotational speed fluctuation caused by load fluctuations of the photoreceptor drum, in the image forming apparatus in which the transfer means and the cleaning means are in contact with, and released from, the peripheral surface of the photoreceptor drum, during image forming processes.

The fourth object of the present invention is to provide a driving apparatus for the photoreceptor, which can actively control the rotation of the photoreceptor without being affected by the backlash of the gear train so that rotational fluctuations of the photoreceptor are decreased, and can always rotate the photoreceptor at a constant speed in spite of fluctuations of loads applied onto the photoreceptor.

An embodiment of this image forming apparatus to accomplish the first object of the present invention is structured as follows. The image forming apparatus comprises: a rotational photoreceptor; a driving system for driving the photoreceptor; detecting means for detecting a rotational information of the photoreceptor successively; and control means for controlling the driving system on the basis of the rotational information detected so as to control a rotation of the photoreceptor.

Another embodiment of this image forming apparatus to accomplish the first object of the present invention is structured as follows. Initially, marking is conducted at a predetermined interval on the peripheral surface of a photoreceptor to be rotated, and a light source to emit a light beam onto the marking is provided in the apparatus. When the reflected light from the marking, thus obtained, is projected onto a line sensor through an image formation lens, the line sensor receives a projection image of the marking. In this case, the line Sensor has a plurality of pixels in a row, in which each pixel outputs an electric signal corresponding to the projection image received as described above. Further, the electric signal obtained from the line sensor is processed by a detecting means, and rotation information of the photoreceptor is obtained. Then, a control circuit controls the rotation of the photoreceptor by the rotation information obtained as described above.

In the above-described image forming apparatus of the present invention, since the rotation of the photoreceptor is detected by movement of the projection image of the marking, projected on the line sensor, the amount of movement of the projection image can be computed on the basis of the whole number of markings in a period. That is, even when the pitch of the markings provided on the photoreceptor is not uniform, the rotation of the photoreceptor can be accurately detected. Further, when the projection image of the marking is formed on the line sensor, an image formation lens is used. Therefore, the dimension of the marking provided on the photoreceptor can be determined by the magnification ratio of the image formation lens. For this reason, there is no possibility in which the marking is required to be specially, minutely provided on the peripheral surface of the photoreceptor drum.

An embodiment of the image forming apparatus for accomplishing the second object of the present invention is structured as follows. The image forming apparatus comprises: a photoreceptor for image formation; a driving system for driving the photoreceptor; an acceleration sensor which is installed on the photoreceptor, and which generates electric signals different from each other depending on changes of one or both of the rotational speed and the rotation acceleration of the photoreceptor; and a control circuit for detecting one or both of the rotational speed information and rotation acceleration information of the photoreceptor from the electric signal obtained by the acceleration sensor. That is, the rotational information detection method of the photoreceptor in the image forming apparatus of the present invention is employed as follows. Initially, the photoreceptor for image formation is rotated by the driving system, and next, the acceleration sensor, which generates the electric signals different from each other depending on changes of one or both of the rotational speed and the rotation acceleration of the rotational body, is installed on the photoreceptor. Thereby, the electric signal, including one or both of the rotational speed information and the rotation acceleration information of the photoreceptor, is obtained. Further, one or both of the rotational speed and the rotation acceleration of the photoreceptor is detected by the control circuit from the electric signal obtained, as described above.

According to the above-described image forming apparatus of the present invention, the information expressing one or both of the rotational speed and the rotation acceleration is directly obtained as an electric signal from the acceleration sensor installed on the photoreceptor, and thereby, the rotation of the photoreceptor can be controlled. Accordingly, no complicated computation processing of electric signals is necessary, and there is no time lag from detection of one or both of the rotational speed and the rotation acceleration, to rotation control of the photoreceptor.

The first embodiment of the image forming apparatus for attaining the third object of the present invention is structured as follows. The image forming apparatus comprises: a rotational photoreceptor for forming an image thereon; a driving system for driving the photoreceptor; a transfer device for transferring the image on the photoreceptor onto a recording sheet; a cleaning device for cleaning residual toner image of the photoreceptor, wherein at least one of the transfer device and the cleaning device is in pressure contact with and released from the photoreceptor; control means for controlling the driving system, wherein the control means has a predetermined drive control program for controlling the driving system so as to control a rotation speed of the photoreceptor, and the control means controls the driving system on the basis of the predetermined control program by prospecting the motion of the transfer device or the cleaning device.

The second embodiment of the image forming apparatus for attaining the third object of the present invention is structured as follows. The image forming apparatus comprises: a photoreceptor; a motor for driving the photoreceptor; a control system for controlling the rotational speed of the motor; a transmission system for transmitting the rotation of the motor to the photoreceptor; a transfer unit and/or a cleaning unit which come into pressure contact with the photoreceptor, and which are released from the pressure contact; and a detecting apparatus for detecting the pressure contact operation and the release operation from the pressure contact of the transfer unit and/or the cleaning unit. In the image forming apparatus, the rotational speed of the motor is controlled by a drive control program, previously installed in the image forming apparatus, according to the detection signal outputted from the detection apparatus for detecting the pressure contact operation and the release operation from the pressure contact of the transfer unit and/or the cleaning unit.

The third embodiment of the image forming apparatus for attaining the third object of the present invention is structured as follows. The image forming apparatus comprises: a photoreceptor; a motor for driving the photoreceptor; a control system for controlling the rotational speed of the motor; a transmission system for transmitting the rotation of the motor to the photoreceptor; a transfer unit and/or a cleaning unit which come into pressure contact with the photoreceptor, and which are released from the pressure contact; and a pressure contact operation/pressure contact release operation control section for controlling the pressure contact operation and the release operation from the pressure contact of the transfer unit and/or the cleaning unit. In the above-described image forming apparatus, the rotational speed of the motor is controlled by a drive control program, previously installed in the image forming apparatus, according to a pressure contact/pressure contact release control signal outputted from the pressure contact operation/pressure contact release operation control section.

When load fluctuations occur on the photoreceptor drum, speed fluctuations of the photoreceptor drum occur due to the rigidity or play of the drive transmission system ranging from the drive motor to the photoreceptor drum even when the drive motor is rotated at a constant rotational speed. Accordingly, in the present invention, the rotational speed of the photoreceptor drum is controlled to a predetermined setting value by detecting the occurrence of the load fluctuations, or by predicting the occurrence of the load fluctuations, and controlling the rotational speed by feeding back the information of the load fluctuations to the drive motor.

In the above-described first embodiment, when a status detection signal, for example, an acceleration signal or an electrical connection signal according to the release of the pressure contact, sent from a state detection sensor attached to the transfer unit or cleaning unit, which comes into pressure contact with the photoreceptor drum, or which is released from the pressure contact, is used as a signal for detecting the generation of the load fluctuations, the generation of the load fluctuations can be relatively easily detected. In a rotational speed control system to detect the speed of the photoreceptor, an instantaneous time lag inevitably occurs because the load fluctuation is detected after the speed fluctuation has occurred, and then the drive speed is controlled by the detected information. However, in this embodiment, because the information of the load fluctuation can be obtained at the same time as the occurrence of the load fluctuation, or before the occurrence of the load fluctuation, the rotational speed can be rather quickly controlled, so that an image with no pitch fluctuation can be obtained.

In the above-described second embodiment, when a signal which controls the pressure contact or release of the pressure contact, is used as a means for predicting the occurrence of load fluctuations, the occurrence of load fluctuations can be easily detected. In the control system to detect and control the speed of the photoreceptor, because the occurrence of load fluctuations is detected after the occurrence of the speed fluctuation, and then, the drive speed is controlled, an instantaneous time lag inevitably occurs. However, in this embodiment, because the information of the load fluctuation can be obtained before the occurrence of the load fluctuation, the rotational speed can be quickly controlled, so that an image with no pitch fluctuation can be obtained.

An embodiment to attain the above-described fourth object is structured as follows. In a driving apparatus for the photoreceptor in which the rotational speed control is conducted so that the photoreceptor is rotated at a predetermined rotational speed through a gear train when the rotational speed of the motor is actively accelerated/decelerated, a braking apparatus, which applies a load onto the photoreceptor, is provided.

In this connection, a preferred embodiment of the present invention, is structured as follows. A torque of the above-described load applied by the braking apparatus, has the following relationship with respect to the inertial moment I of the photoreceptor and the acceleration B at the time of the reduced speed control, $$T \cong I \cdot B$$

BRIEF DESCRIPTION OF THE DRAWINGS

FIG. 2 is a generalized view showing a means for detecting a marking, provided on the peripheral surface of a photoreceptor drum, by a line sensor in the present invention.

FIGS. 3 (*a*) and 3(*b*) are general views showing a means for detecting the movement of a marking by a projection image of the marking formed on the line sensor at two different times, in the present invention.

FIGS. 12(*a*) through 12(*c*-2) are illustrative views showing the speed of a motor and that of a photoreceptor drum controlled by a speed fluctuation moderation signal.

FIGS. 18(*a*) and 18(*b*) are graphs showing the status of generation of rotational fluctuations of the conventional photoreceptor.

DETAILED DESCRIPTION OF THE PREFERRED EMBODIMENT

Figure 4:
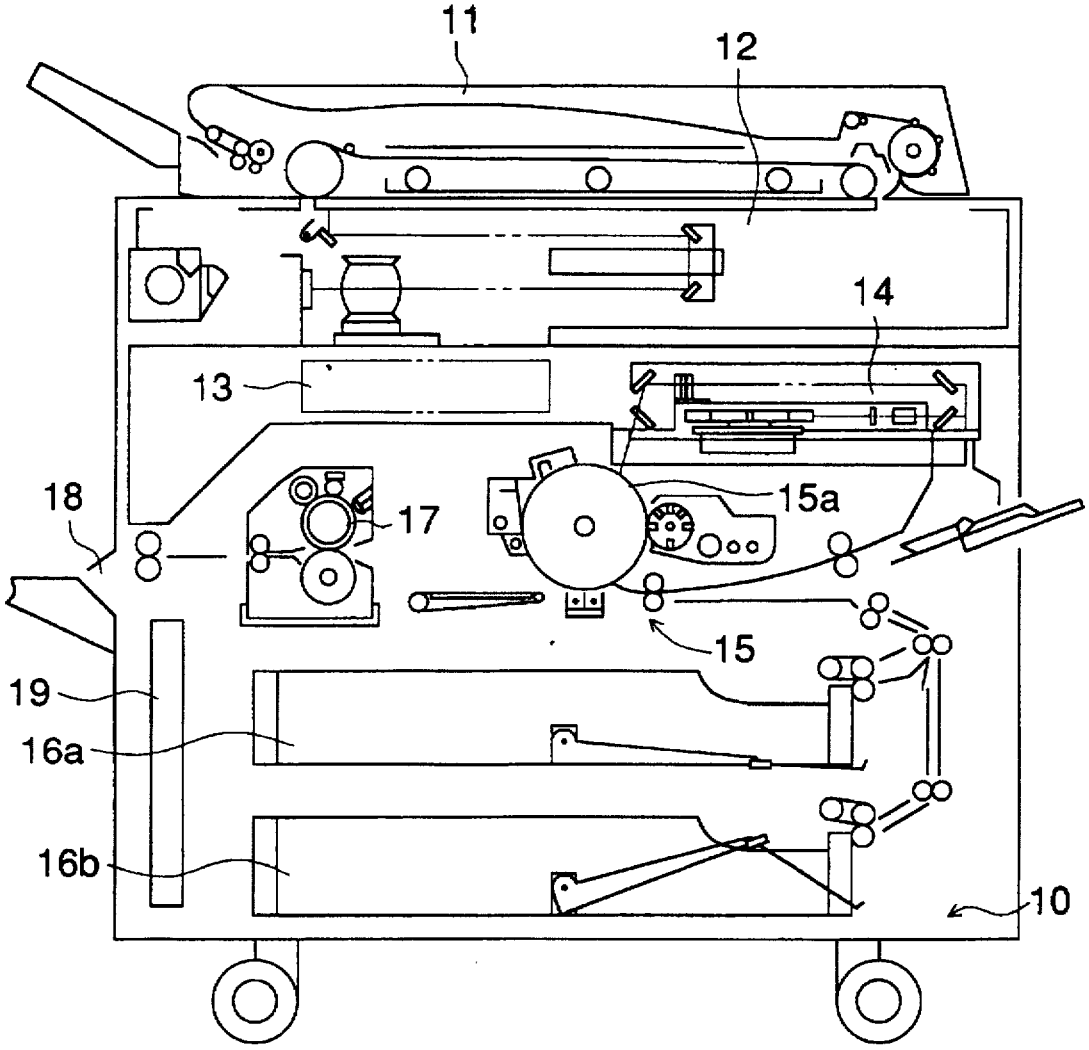
FIG. 4 is a view showing the structure of a general image forming apparatus.
Figure 5:
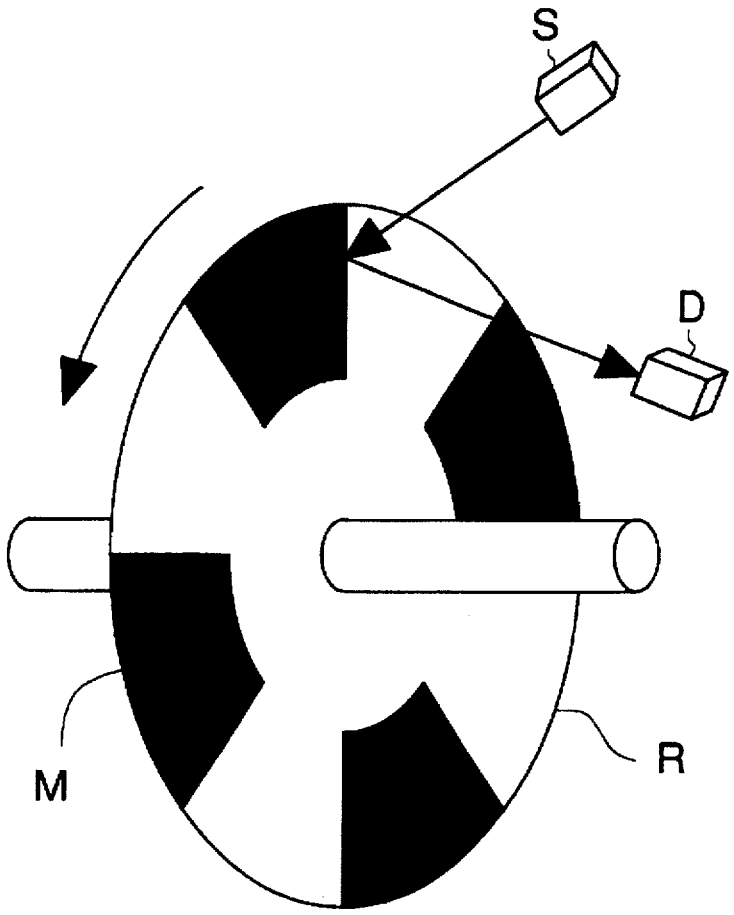
FIG. 5 is a view showing the structure of a conventional encoder using a point sensor.
Figure 6:
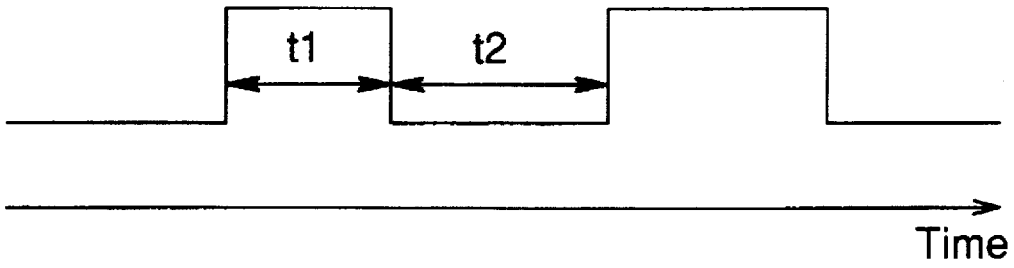
FIG. 6 is a view showing a waveform of a signal obtained by a conventional encoder.

General operations and specifications of an example to attain the first object of an image forming apparatus, in which a rotational information detector of the present invention is mounted, are the same as those in FIG. 4 and an explanation of FIG. 4. Therefore, these operations and specifications have, specifically, no relationship with the present invention except the rotation control means of the photoreceptor, which will be described below, and accordingly, the explanation of these general operations and specifications is omitted.

Figure 1:
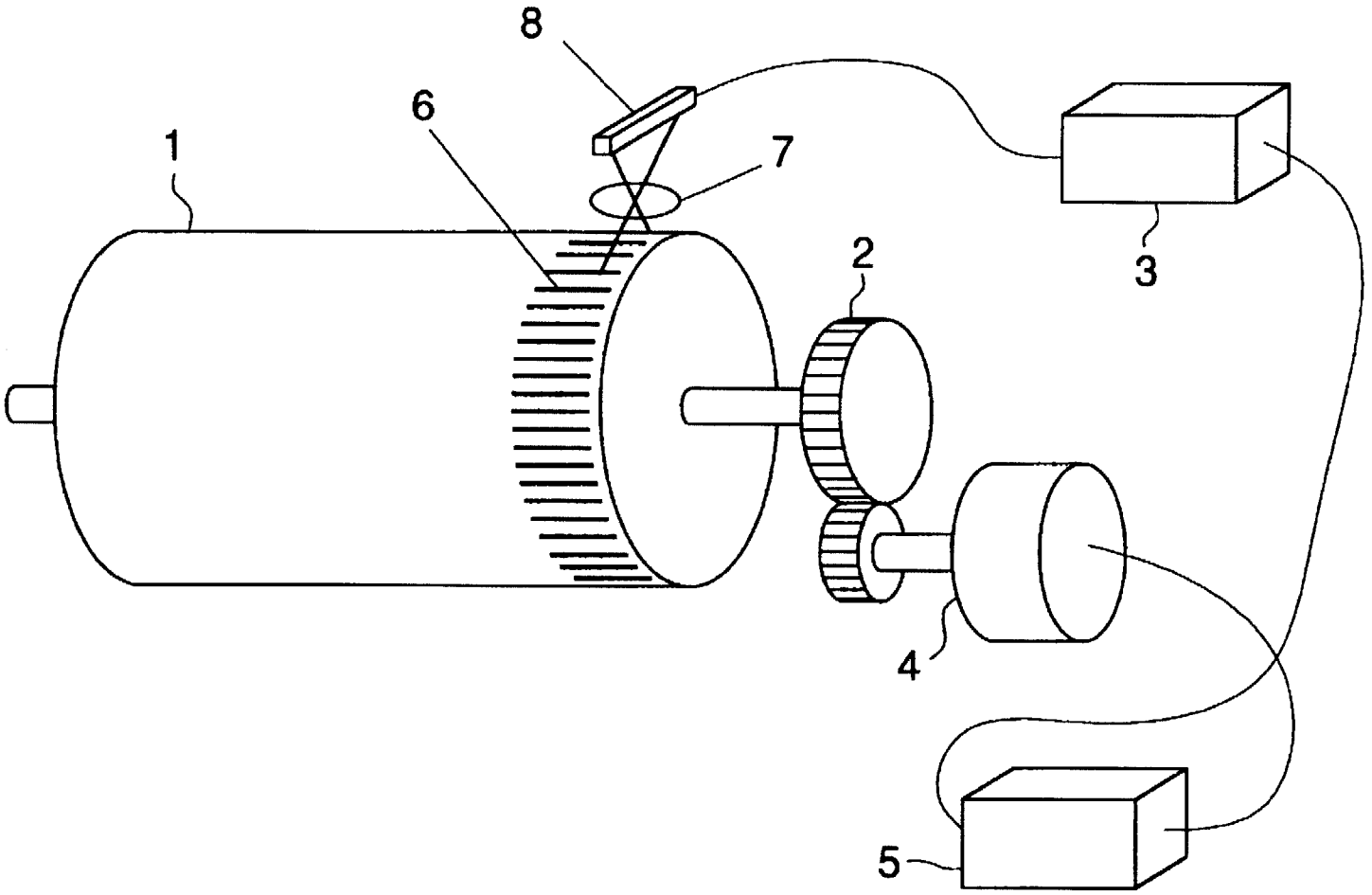
FIG. 1 is a view showing the structure of a rotation control means of a photoreceptor of the present invention.

As shown in FIG. 1, the image forming apparatus of the present invention is provided with a rotation control means for actively controlling the rotation of a photoreceptor drum 1. A marking 6 is provided on the peripheral surface of the photoreceptor drum 1 at a predetermined interval. In this case, the position, on which the marking is to be provided on the peripheral surface of the photoreceptor drum 1, may be on any of the outside, inside or side surface of the photoreceptor drum 1, and alternatively, a rotational body is coaxially attached to the rotation shaft of the photoreceptor drum 1, and the marking 6 may be provided on the rotational body. A light beam is radiated onto this marking 6 from a light source, which is not shown in the drawing, and an image according to the reflected light beam is formed on a line sensor 8 by an image formation lens 7. A line sensor 8 which has received the reflected light including the projection image of the marking 6, converts the projection image into an electric signal, and sends the signal to a processing unit 3. In the processing unit 3, rotational information of the photoreceptor drum 1 is obtained by processing, which will be described later, according to the electric signal sent from the line sensor 8. Further, the processing unit 3 sends the rotational information of the photoreceptor drum 1, obtained as above, to a control circuit 5. In the control circuit 5, the rotation of a drive system is controlled according to the rotational information sent from the processing unit 3 so that the rotation of the photoreceptor drum 1 becomes optimum for image formation. In this case, the drive system of the photoreceptor drum 1 is composed of a motor 4 and a reduction unit 2, and the motor 4 rotates the photoreceptor drum 1 through the reduction unit 2. In this example, the rotation of the photoreceptor drum 1 is controlled by a so-called active control, and a circuit for this active control is used. This active control is a control by which data prediction, or the like, is conducted with respect to the rotational information obtained from the processing unit 3, by referring to empirical data previously stored in a memory, or by compensating for changes of data depending on various environmental changes. This rotation control is a relatively complicated but a highly accurate one. However, the rotational information detection itself, using a line sensor, which is one of features of the present invention, can also be applied for a more simple rotation control. For example, this can also be used for the conventional feed back control method. In this feed back control, the obtained rotational information of the photoreceptor drum 1 is sent directly to the drive system as a controlled variable of the drive system, and the drive system is thereby controlled.

The line sensor 8 used in this example is a CCD element, with a maximum of 5000 pixels, which can be commonly purchased at relatively low cost. In this 5000 pixel CCD, the length of the CCD is 35 mm, and the length of one pixel is 7 μm. As shown in FIG. 2, the photoreceptor drum 1 is rotated at 15 rpm in the arrowed direction, and the photoreceptor drum 1, the diameter of which is 180 mm, is rotated at, approximately, the peripheral speed of 141.3 mm/sec. A projection image of the marking 6, provided on the peripheral surface of the photoreceptor drum 1 at a period of T, is formed on the line sensor 8 by an image formation lens 7 having a magnification ratio of 1/M. As shown in FIG. 2, in the line sensor 8, pixels exist which respectively receive the reflected light, having an intensity of light different from each other, as shown by hatching and blanks, corresponding to a portion which receives the projection image of the marking 6, or a portion which receives the reflected light from a blank portion on which no marking is provided. Accordingly, the line sensor 8 generates respective electric voltage (or current) signals corresponding to the intensity of light received by each pixel.

In the present invention, the electric signal obtained from the line sensor 8 is structured such that the signal has the information corresponding to not less than one period of the marking 6 at any arbitrary time. The marking period T of the marking 6 is determined by the relationship between the length L of the element of the line sensor and the number of pixels, and the magnification ratio 1/M of the image formation lens 7. As described above, the length L of the element of the line sensor=35 mm, and the number N of pixels=5000. Since the magnification ratio of the image formation lens 7 used in this system is 1/10 (M=10), the period T of the marking is 3.5 mm according to the related equation, T=L× 1/M. The processing unit 3 temporarily stores the information corresponding to the electric signal sent from the line sensor 8, and when two information obtained at two different times are compared with each other, the rotational information of the photoreceptor drum 1 is detected. This method will be explained below, while referring to FIGS. 3(*a*) and 3(*b*) as an example. Initially, the information corresponding to the electric signal sent from the line sensor 8 at time t is stored in a memory means. As shown in FIG. 3(*a*), this stored information corresponds to not less than one period of the marking 6. Although, actually, the information from 5000 pixels is stored in the memory means, this is shown in simplified status in FIG. 3(*a*). In FIG. 3(*a*), the hatched portion is a portion in which the projection image from the marking 6 is received. Then, the information corresponding to the electric signal sent from the line sensor 8 at the time (t+α), which is delayed from the time t by the time α, is again stored in the memory means. As shown in FIG. 3(*b*), this stored information also corresponds to not less than one period of the marking 6.

The processing unit 3 compares the information at the time t with the information at the time (t+a), which are obtained as described above, and the amount of the movement, which is hatched in the drawing, of the projection image of the marking 6 during time α is detected. That is, the amount of the movement represents the peripheral speed of the photoreceptor drum 1. Further, when this peripheral speed is compared with each other at each unit time, it can be checked whether or not the photoreceptor drum 1 is rotated at a constant speed. In the processing unit 3, the period of time, which is required for comparison of two units of information at two different times, is within 247 μsec, even when the calculation is conducted with an accuracy of 1%, because the peripheral speed of the photoreceptor drum 1 is approximately 141.3/sec, and the period T of the marking is 3.5 mm. This period of time is sufficient for the calculation with a low cost CPU. Further, naturally, the high speed processing can be carried out by a calculation circuit for exclusive use. Still further, even when the structure is employed in which the calculation speed is so slow that the entire calculations can not be conducted within the above-described period of time, when each of the information of 5000 pixels is compared with that of other pixels, the peripheral speed of the photoreceptor drum 1 can be detected as follows. A plurality of units of status information, which are predicted in the future of time α after time t, are previously prepared in the memory means, and then, the information obtained at the time (t+α) is compared with the prepared information. When the number of units of information to be calculated is further narrowed down, and this operation is repeated, the peripheral speed of the photoreceptor drum 1 can be detected within the shorter period of time. The electric signal obtained from the line sensor 8 is outputted as an analog signal. However, when this electric signal is compared and calculated by the digital circuit provided in the processing unit 3, this analog signal is required to be converted into a multi-valued digital signal. In this case, although the present invention can be carried out by converting the analog signal to binary digits, the accuracy of the comparison calculation can be further increased when the analog signal is A/D converted into the multi-value, which is more accurate than the binary. For example, when an image, due to the reflected light from the marking 6, is formed on the line sensor 8, and an end of the projection image for one period of the marking is positioned at an intermediate position of any pixel of the line sensor 8, an electric signal outputted from the pixel, by which an end of the projection image is received, is different from the output signal from a pixel, by the entire area of which the projection image of the marking 6 is received. When the electric signal from the line sensor 8 is binarized, this end of the projection image is recognized as 0 or 1 (which means existence or non-existence of the projection image) by a threshold value for judgement. Accordingly, in any case, an error corresponding to one pixel occurs in the length of the projection image. However, when the electric signal outputted from the line sensor 8 is converted into non-binary multi-values, the output from the pixel, by which an end of the projection image is received, and the output from the pixel, by the entire area of which the projection image is received, are judged against each other, and therefore, one end of the projection image of the marking 6 can be accurately recognized. For the reasons described above, when the comparison calculation is operated, the amount of movement of the marking can be judged while the length of the projection image of the marking 6 is accurately recognized.

In a conventional encoder using a point sensor, the marking information at only one point of the rotational body can be obtained at a point of time. Therefore, there is a relationship of 1 to 1 between the marking and the signal obtained from an optical sensor. The accuracy of the rotational speed of the rotational body detected by the optical sensor depends on the accuracy of the marking. However, in the present invention, since a line sensor is used as the optical sensor, the information of the marking of not less than one period can be simultaneously obtained at a point of time, and the movement of the marking of not less than one period can be recognized as a group. That is, according to the present invention, even when any error exists in the pitch of the marking, since the marking of one period is read as a group of information, the accuracy of rotational speed detection of the rotational body is not adversely affected.

Further, in the present invention, when an image of the reflected light from the marking provided on the peripheral surface of the photoreceptor drum 1, which is a rotational body, is formed on the line sensor 8, the image formation lens is used. Accordingly, the period T of the marking is determined by the magnification ratio of the image formation lens. Conventionally, although the accuracy of 10 μm through 50 μm has been required for marking, the accuracy can be as low as 3.5 mm.

As described above, according to the present invention, the rotation of the photoreceptor drum can be very accurately controlled by the low cost structure, and an image of high quality can be formed in the image forming apparatus.

General operations and specifications of an example for attaining the second object of an image forming apparatus, in which the rotational information detector of the present invention is installed, are the same as those shown in FIG. 4, and an explanation thereof (having no special relationship with the present invention except with respect to the rotation control means of the photoreceptor) will be described later. Accordingly, the explanation of general operations and specifications of the image forming apparatus will be omitted.

Figure 7:
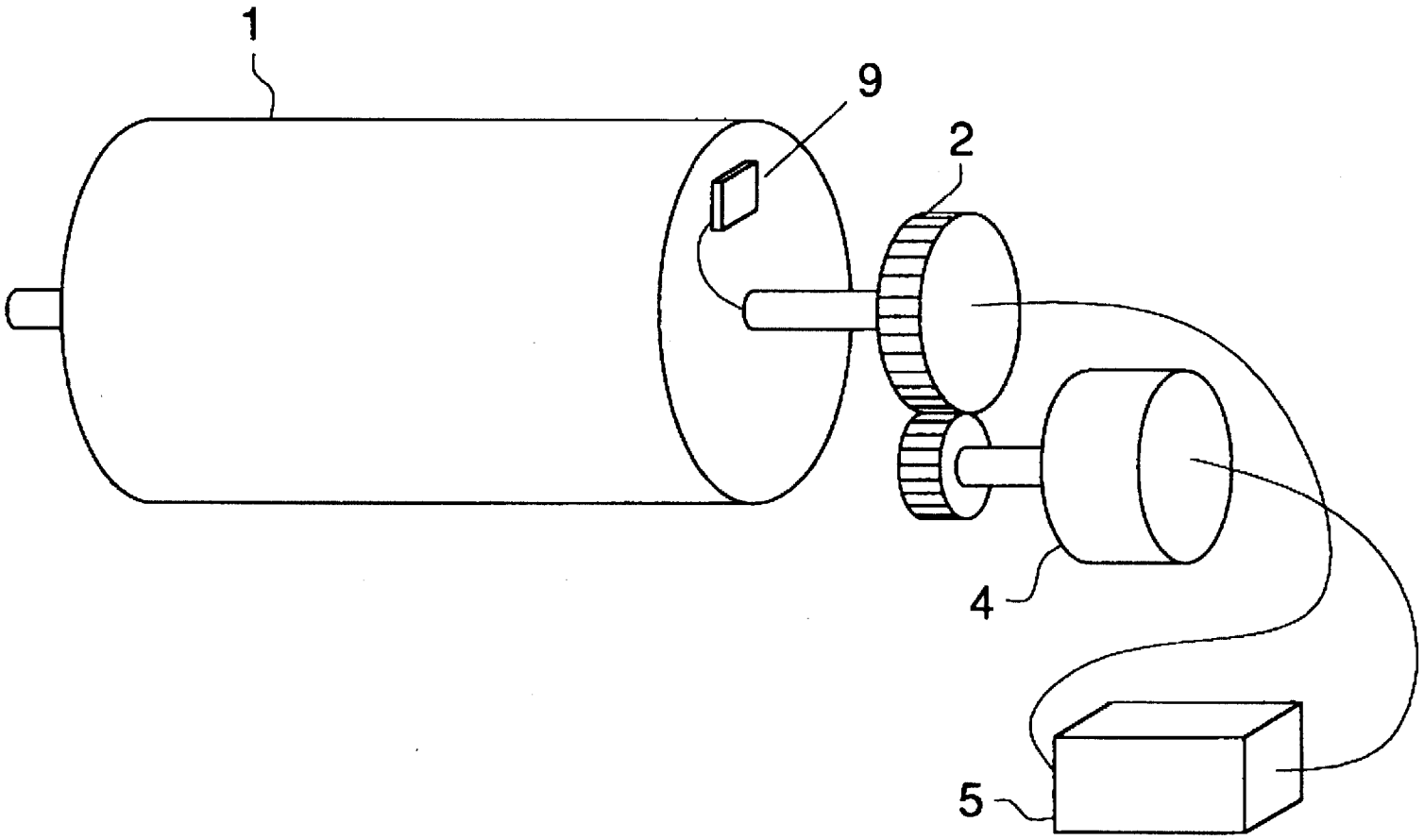
FIG. 7 is a view showing the rotation control means for the photoreceptor according to the present invention.

In the image forming apparatus according to the present invention, a rotation control means for actively controlling the rotation of the photoreceptor drum 1 is provided as shown in the example in FIG. 7. The above-described impact sensor, by which the rotation acceleration can be detected, is mounted on the peripheral surface of the photoreceptor drum 1 as an acceleration sensor 9. In this case, the mounting position of the acceleration sensor 9 may be a position on either the outside, the inside, or the side surface of the photoreceptor drum 1, as long as the position is on the peripheral surface of the photoreceptor drum 1. This acceleration sensor 9 sends the obtained rotation acceleration information of the photoreceptor drum 1 to a control circuit 5. By the control circuit 5, the rotation of the driving system is controlled according to the rotation information sent from the acceleration sensor 9 so that the rotation of the photoreceptor drum 1 is optimum for image formation. In this case, the driving system is composed of a motor 4 and a reduction unit 2, and the driving force of the motor 4 rotates the photoreceptor drum 1 through the reduction unit 2.

The acceleration sensor 9 applicable to the present invention may be the above-described gyro, pressure sensor or the like, other than the impact sensor, as long as a means for directly converting the pressure to an electric signal by a piezoelectric element or the like, is applied to the sensor. However, since the impact sensor has a relatively simple structure, and can be purchased at low cost, it is preferably used. The structure of this impact sensor, will be explained below, referring to FIG. 8.

Figure 8:
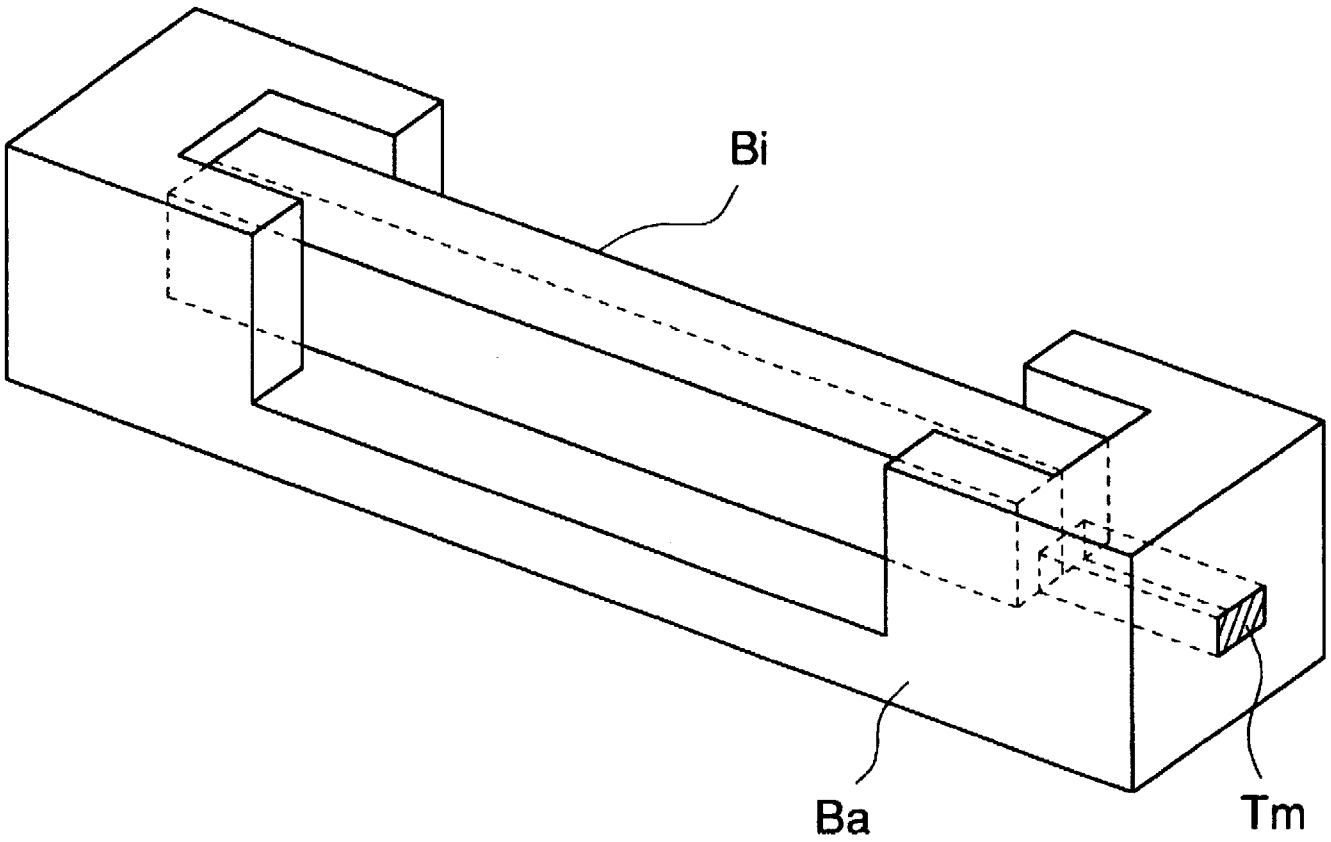
FIG. 8 is a perspective view showing the structure of an acceleration sensor which is applicable to the present invention.

In FIG. 8, Bi is a bi-morph piezoelectric element in which a piezoelectric element such as a piezo electric ceramic, or the like, is formed into a bi-morph structure, and is mounted on a base Ba. Further, a terminal Tm for outputting an electric signal is connected to the bi-morph piezoelectric element Bi. In the hi-morph piezoelectric element, when any pressure is impressed upon the element, the cell-shaped element is deflected by compression, and an electric signal is generated due to this compression. Then, the generated electric signal is transmitted to an electric circuit through the terminal Tm. In the impact sensor which is applied to this example of the present invention as an acceleration sensor, the sensitivity to an impact (acceleration) is 2 mV/G, and the frequency characteristic is 100 through 20 KHz. In the image processing apparatus of this example, a vibration, the frequency of which is approximately 100 through 500 Hz, occurs due to dimensions of the casing of the apparatus, the structure of the driving system, or the like. However, the impact sensor having the above characteristics is sufficient for detection of the rotational speed and its change of the photoreceptor drum 1.

One or both electric signals of the rotational speed information and the rotational acceleration information outputted from the acceleration sensor 9 are received by a control circuit 5, and one or both of the rotational speed and the rotational acceleration of the photoreceptor drum 1 are directly detected. The control circuit 5 controls the rotation of the photoreceptor drum in real time without any complicated calculation. In this case, the direction of detection of the acceleration sensor is directed to one or both of the direction of rotation and the direction of the concentric circle of the photoreceptor drum 1. This is due to the following reason. When one acceleration sensor is used and is mounted such that the direction of detection of the acceleration sensor is directed toward the direction of the rotation of the photoreceptor drum 1, a signal corresponding to the rotation acceleration of the photoreceptor drum 1 is outputted. When the acceleration sensor is mounted such that the direction of detection of the acceleration sensor is directed toward the direction of the concentric circle of the photoreceptor drum 1, the acceleration sensor detects the centrifugal force of the photoreceptor drum 1, and outputs a signal corresponding to the rotational speed of the photoreceptor drum 1. Naturally, when two acceleration sensors are mounted on the photoreceptor, and their directions of the detection are respectively directed to the rotational direction and the direction of the concentric circle of the photoreceptor drum 1, both the rotational speed and the rotational acceleration can be simultaneously detected. In this example, it is necessary that at least one of the changes of the speed or the acceleration of the photoreceptor drum 1 is detected and controlled so that the rotation of the photoreceptor drum 1 can be constant. In experiments conducted by the inventors, the following were found. When only the speed of the photoreceptor drum 1 is detected and controlled, highly accurate control can be achieved. When only the acceleration is detected, the calculation processing time can be mostly reduced, and the highly accurate control can also be conducted.

Further, when the above-described gyroscope is used instead of two acceleration sensors, both the rotational speed and the rotation acceleration of the photoreceptor drum 1 can be simultaneously obtained by one gyroscopic sensor. This is for the following reason. Intrinsically, the gyroscope is a means for simultaneously detecting the direction of movement in the three dimensions of a moving body and its acceleration in respective directions, and is structured as if it is composed of a plurality of impact sensors. Practically, in a gyroscope, a base, like a polyhedric pole, with at least 3 surfaces, is provided, and a plurality of the same piezoelectric elements as the bi-morph piezoelectric element of the impact sensor, shown in FIG. 8, are installed on a plurality of the side surfaces of the base. Accordingly, the base is deflected by the stress, applied onto the gyroscope, in all three dimensional directions. Accordingly, a plurality of piezoelectric elements, each of which receives the stress applied in the direction in which the element is installed, corresponding to the deflection of the base, respectively output electric signals. That is, the stress, applied onto the gyroscope, in the three dimensional directions are respectively converted into electric signals, and are outputted. As described above, according to the structure in which a plurality of acceleration sensors or a gyro are provided, it can be simultaneously detected whether a change in the rotational speed occurs or not, while it is being monitored whether the photoreceptor drum 1 is rotated at a predetermined constant speed or not, and more complicated control can be conducted.

In this connection, in the present invention, it is necessary to directly install the acceleration sensor 9 on the photoreceptor drum 1. Then, in order to send the output from the acceleration sensor 9, which is rotated together with the photoreceptor drum 1, to the control circuit 5, it is necessary to provide an electrical contact point, which can move freely with respect to the rotation of the photoreceptor drum 1, in the output transmission path. However, when this contact point is provided in the above path, noise tends to occur, so that it is difficult to accurately send the output signal from the acceleration sensor 9 to the control circuit 5. In this example, an A/D converter, which is not shown in the drawings, is installed on the photoreceptor drum 1 together with the acceleration sensor 9, and the signal from the acceleration sensor 9 is digitized before the signal passes through the contact point. Accordingly, the signal, which is inputted into the control circuit 5 through the contact point, is a digital signal, which is barely affected with contact point noises.

As a countermeasure for the contact point noise described above, it is considered that the signal from the acceleration sensor 9 is moderated into an electric wave and sent to the control circuit 5. In this case, since the signal can be transmitted to the control circuit 5 without passing through the contact point, noise due to the contact point does not occur.

In the image processing apparatus according to the present invention, the electric signal from the acceleration sensor 9 is received by the control circuit 5, which directly detects one or both of the rotational speed and the rotation acceleration of the photoreceptor drum 1, and controls the rotation of the photoreceptor drum 1. Accordingly, it is not necessary to detect the rotational speed of the photoreceptor drum by an encoder, or the like, nor further, to detect changes in rotational speed by the computing processing means.

Before an example to attain the third object of the present invention is explained, the structure and operation of an image forming apparatus of the present invention will be described below, while referring to FIG. 9.

Figure 9:
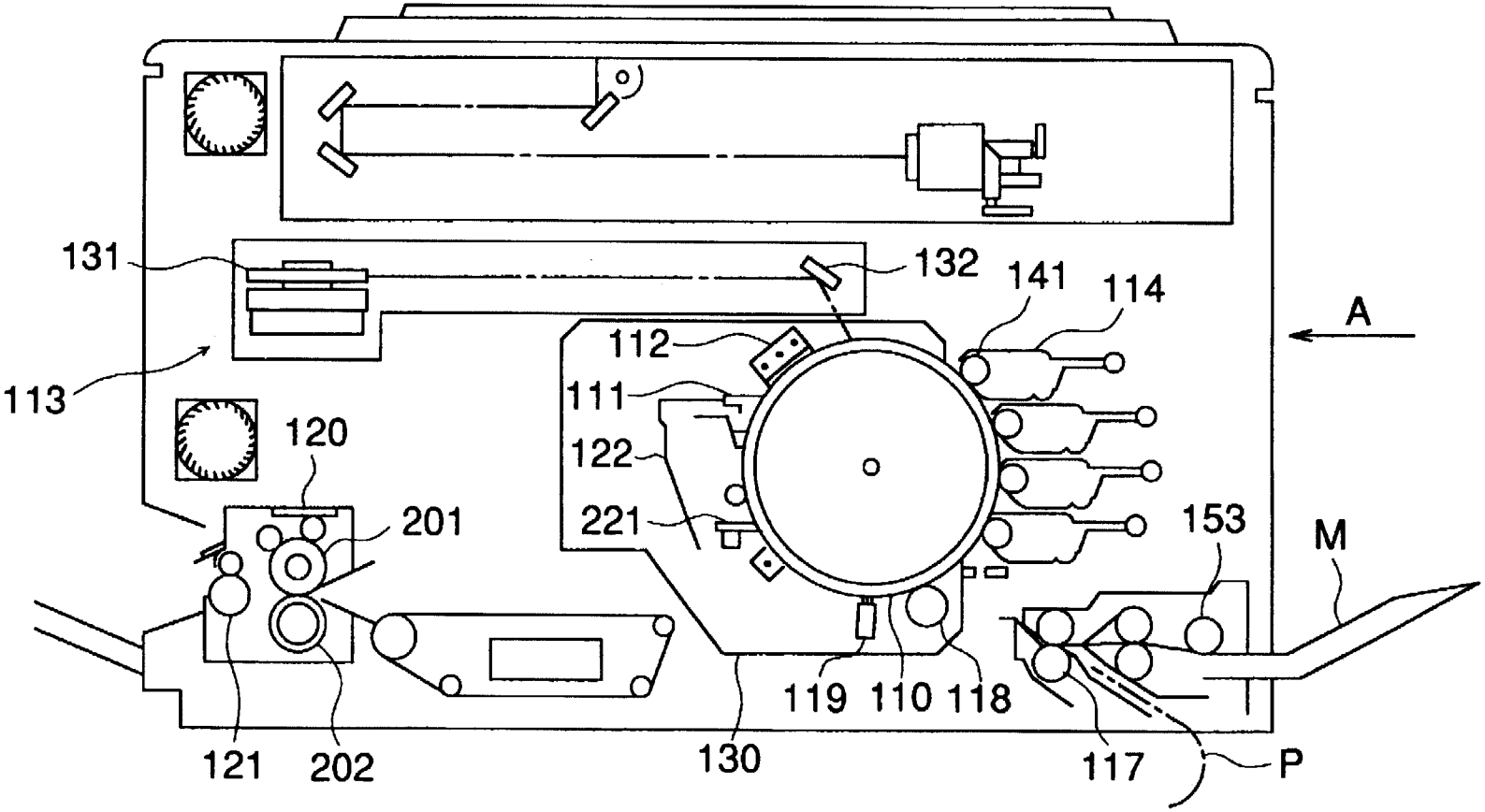
FIG. 9 is a sectional view of an example of the image forming apparatus of the present invention.

In FIG. 9, numeral 110 is a photoreceptor drum, which is an image carrier. An OPC photoreceptor is coated on the drum, and the drum is grounded and rotated clockwise. Numeral 112 is a scorotron charger, by which the peripheral surface of the photoreceptor drum 110 is uniformly charged to the potential voltage of VH by a corona discharge, which is conducted by a grid, the potential voltage of which is VG, and a corona discharging wire. Before this charging by the scorotron charger 112, an exposure by a PCL 111 is conducted using a light emitting diode, etc., so that hysteresis of the photoreceptor due to preceding printing operations is eliminated, and the peripheral surface of the photoreceptor is electrically discharged.

After the photoreceptor has been uniformly charged, an image exposure according to an image signal is conducted by an image exposure means 113. By the image exposure means 113, scanning is conducted as follows. A light beam emitted from a laser diode, which is a light source, not shown in the drawing, passes through a rotating polygonal mirror 131, an fθ lens, etc., and its optical path is bent by a reflection mirror 132 for scanning. A latent image is formed by the rotation of a photoreceptor drum 110 (subsidiary scanning). In this example, exposure is conducted on a character portion, and a reversed latent image, having a lower potential voltage VL, is formed.

Developing units 114, in which developers composed of toners, such as yellow (Y), magenta (M), cyan (C), black (K), etc., and carrier are respectively loaded, are provided around the photoreceptor drum 110. Initially, the first color development is conducted by a developing sleeve 141, in which a magnet is housed, which is rotated while retaining developer thereon. Developer is composed of carrier and toner, wherein the carrier is made of ferrite as a core, and an insulation resin is coated around the core, and toner is made of polyester as a main material, and pigments corresponding to colors, charge control agents, silica, titanium oxide, etc., are added to the main material. The developer is regulated to have the layer thickness of 100 through 600 μm on the developing sleeve 141 by a layer forming means, and conveyed to a developing area.

The dimension of a gap formed between the developing sleeve 141 and the photoreceptor drum 110 in the developing area is 0.2 through 1.0 mm, which is larger than the layer thickness of the developer, and an AC bias voltage of $V_{AC}$ and a DC bias voltage of $V_{DC}$ are superimposed on this gap. Since $V_{DC}$, $V_H$, and an electric charge due to toner charging have the same polarity, the toner, which is triggered to separate from the carrier by $V_{AC}$, does not adhere to a $V_H$ portion, the potential voltage (an absolute value) of which is higher than that of $V_{DC}$, but adheres to a $V_L$ portion, the potential voltage of which is lower than that of $V_{DC}$, and after that, a latent image is visualized (reverse development).

After the first color visualizing operation, the system enters into the second color image formation process. The peripheral surface of the photoreceptor drum 1 is uniformly charged again by the scorotron charger 112, and a latent image according to the second color image data is formed by the image exposure means 113. In this case, the discharging operation conducted by the PCL 111 in the first color image formation process, is not conducted because the toner, adhered to the first color image portion, scatters due to the sudden decrease of the surrounding potential voltage.

The whole peripheral surface of the photoreceptor drum 110 is uniformly charged again so that the photoreceptor has the potential voltage of $V_H$. In the photoreceptor, the same latent image as in the first color is formed on a portion in which the first color image does not exist, and the latent image is developed. In a portion in which development is carried out again with respect to a portion having the first color image, a latent image having the potential voltage of $V_M'$ is formed by light-shielding due to the adhered first color toner, and electric charges of the toner itself, and development is conducted corresponding to the potential difference between $V_{DC}$ and $V_M'$. In a portion in which the first color image and the second color image are superimposed, when the first color development is conducted after a latent image having the potential voltage of $V_L$ has been formed, the balance between the first color image and the second color image is lost. Accordingly, in some cases, the exposure amount of the first color is decreased, and the intermediate potential voltage $V_M$ having the relationship, $V_H>V_M>V_L$, is used.

In the same way as the second color image formation process, the third and the fourth color image forming processes including charging, image exposure and development are carried out, and the leading end portion of the visualized image is moved to the transfer section, while the four-color visualized image is being formed on the peripheral surface of the photoreceptor drum 110.

A recording sheet P, conveyed from a sheet feed cassette through a semi-circular roller (not shown in the drawings), temporarily stops, and then, the recording sheet P is conveyed to the transfer area by the rotation of a sheet feed roller 117 in timed relationship with the transfer unit.

In the transfer area, the transfer roller 118, which is the transfer unit, which has been separated from the peripheral surface of the photoreceptor drum 110, comes into contact with the peripheral surface of the photoreceptor drum 110, in timed relationship with transfer timing, and the recording sheet P, which is fed from the sheet feed cassette, is sandwiched between the roller and the peripheral surface so that the multi-color image is simultaneously transferred. When the transfer onto the recording sheet P has been completed, the transfer roller 18 is released from pressure-contact.

Next, the recording sheet P is discharged by a separation brush 119, which comes into contact with the sheet P almost simultaneously with the transfer roller 118, and is separated from the peripheral surface of the photoreceptor drum 110. The separated recording sheet P is conveyed to a fixing unit 120, and delivered outside the apparatus through a delivery roller 121 after toner on the sheet P has been fused by heat and pressure of a heat roller 201 and a pressure roller 202. The transfer roller 118 and the separation brush 119 are withdrawn from the peripheral surface of the photoreceptor drum 110 after the recording sheet P has been passed between them, and the transfer roller 118 and the separation brush 119 are ready for the next toner image formation.

Residual toner on the photoreceptor drum 110, from which the recording sheet P has been separated, is removed from its surface and its surface is cleaned, when a blade 221 of a cleaning unit 122 comes into pressure contact with the surface of the drum 110. Then, the peripheral surface of the photoreceptor drum 110 is discharged again by the PCL 111, and charged by the charger 112, and enters into the next image formation process. The blade 221 is immediately withdrawn from the peripheral surface of the photoreceptor drum 110 after cleaning of the photoreceptor surface.

Figure 10:
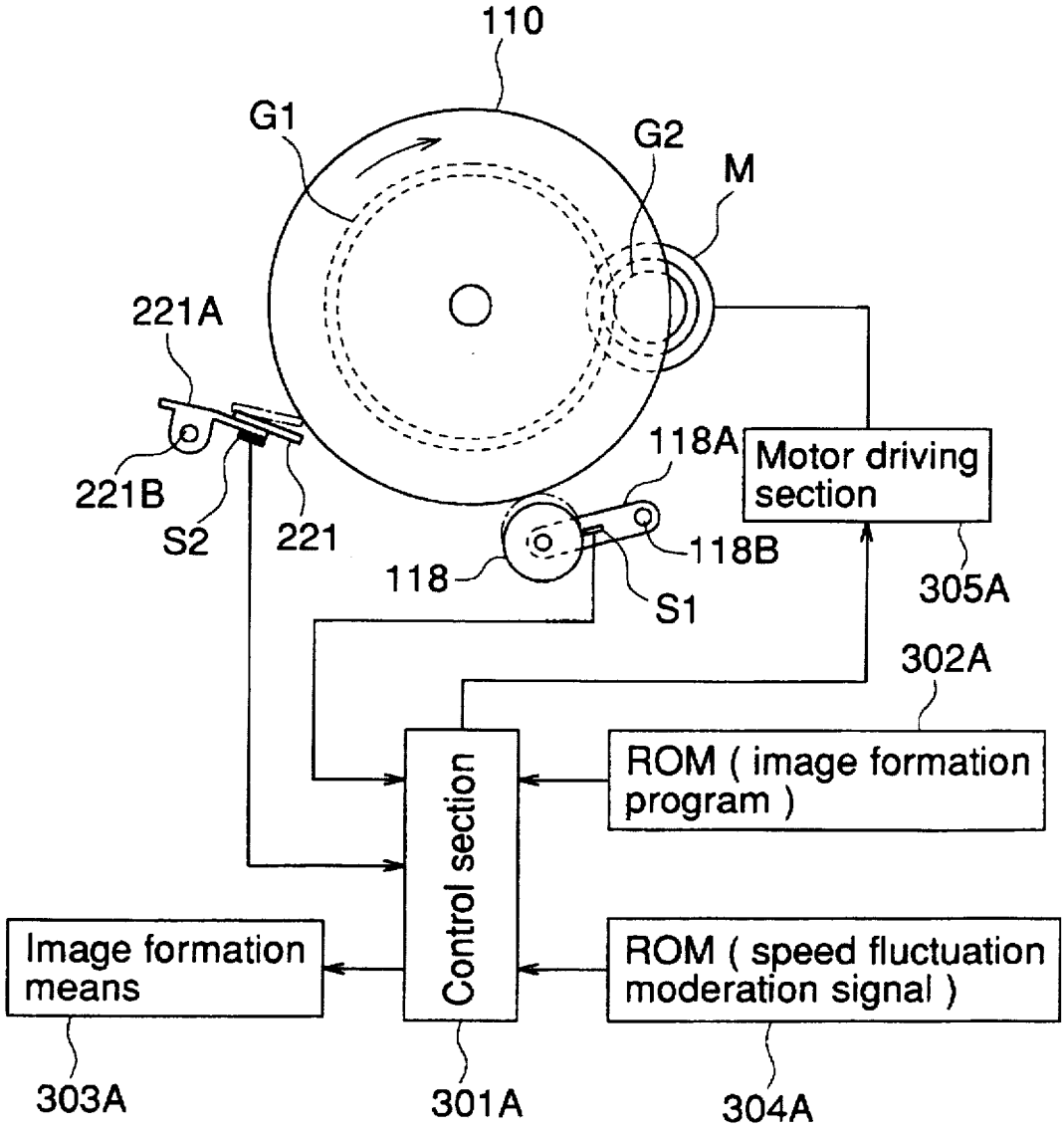
FIG. 10 is a view showing the structure of the first example of the present invention.
Figure 11:
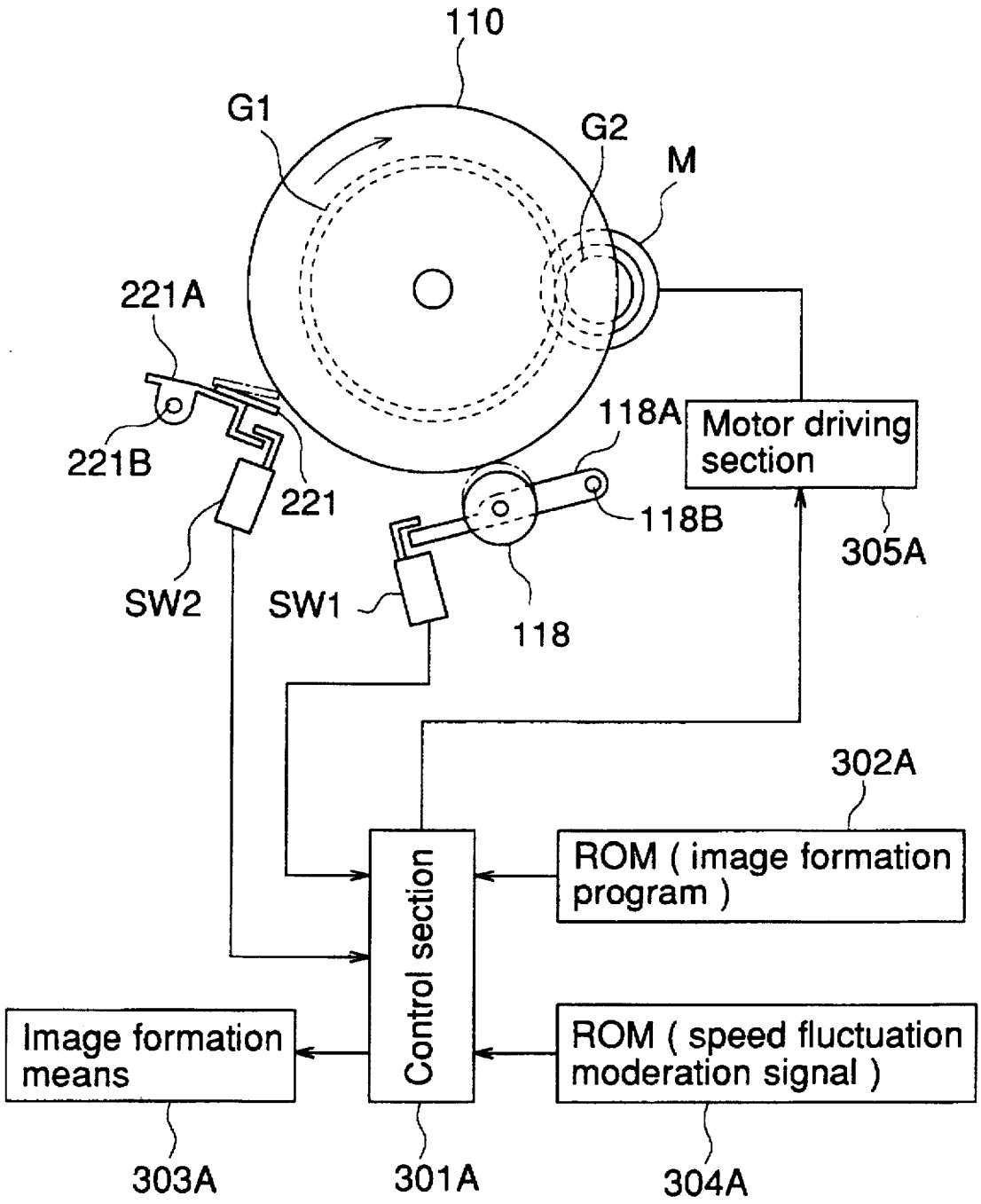
FIG. 11 is a view showing the structure of another example of the present invention.

Referring to FIGS. 10, and 11, and FIGS. 12(*a*) through 12(*c*-2), an example of the first embodiment will be described below.

In FIG. 10, a control section 301A is a control portion of the image forming apparatus shown in FIG. 9. An image is formed by an image formation means 303A, including a scorotron charger 112, an image exposure means 113, developing units 114, a transfer roller 118, a cleaning unit 122, etc., according to a program read from a ROM 302A in which an image formation program is stored. In the photoreceptor drum 110, a power transmission system is composed of a gear G1, coaxially fixed on the photoreceptor drum shaft, and a gear G2 of the drive motor M, engaged with the gear G1. The drive motor M is driven through a motor drive section 305A by a command from the control section 301A according to the image formation program. The photoreceptor drum 110 is rotated clockwise. As the drive motor M used in this example, a stepping motor, a DC motor, or a drive motor with an active control system, which will be described later, can be used.

In the example shown in FIG. 10, an acceleration sensor S1 is integrally provided with a rotation member 118A. The rotation member 118A is rotated clockwise around a rotation center 118B according to commands from the control section 301A, and the transfer roller 118 comes into pressure contact with the peripheral surface of the photoreceptor drum 110 for transferring. The acceleration sensor S1 detects the rotational operation of the rotation member 118A, and a detection signal of the pressure contact motion is outputted to the control section 301A simultaneously with the contact pressure of the transfer roller 118 with the photoreceptor drum 110, or before the pressure contact. Further, in the same way as the above described operations, when the transfer roller 118 is released from the pressure contact, a detection signal for the pressure contact release operation is outputted from the acceleration sensor S1 to the control section 301A.

In the same way, a cleaning blade 221 is supported by a holding member 221A to which the acceleration sensor S2 is attached. The holding member 221A causes the cleaning blade to slide on the peripheral surface of the photoreceptor drum 110 for the cleaning operation, when the holding member 221A is rotated counterclockwise around the rotation center 221B according to commands from the control section 301A. The acceleration sensor S2 detects the rotation of the holding member 221A, and outputs pressure contact detection signals of the cleaning blade to the control section 301A, simultaneously with the pressure contact of the cleaning blade or before the pressure contact of the cleaning blade. In the same way, when the the cleaning blade 221 is released from the pressure contact, a detection signal of the pressure contact release operation is outputted from the acceleration sensor S2 to the control section 301A.

In this example, the following operations are conducted. In the control section 301A, a drive control program (speed fluctuation moderation signal), which cancels acceleration or deceleration of the photoreceptor drum 110, when the transfer roller 118 comes into pressure contact with, or the transfer roller 118 is released from the pressure contact with the photoreceptor drum 110, and when the cleaning blade 221 comes into pressure contact with, or is released from the pressure contact with the photoreceptor drum 110, is read from the ROM 304A, according to the detection signal of the pressure contact and the release of the pressure contact outputted from the acceleration sensors S1 and S2, and is outputted to the motor drive section 305A.

FIGS. 12(*a*) through 12(*c*-2) are illustrative views of the above-described operations. As shown in FIG. 12(*a*), a speed fluctuation moderation signal is outputted to the motor drive section 305A at the time of: pressure contact of the transfer roller 118 with the photoreceptor drum 110 (ON, (A)); pressure contact of the cleaning blade 221 (ON, (B)); release from the pressure contact of the transfer roller 118 (OFF, (C)); and release from the pressure contact of the cleaning blade 221 (OFF, (D)). The speed of the motor M is fluctuated as shown in FIGS. 12(*b*-1) through 12(*b*-4). The speed of the photoreceptor drum 110 is shown in FIG. 12(*c*-1) in which speed fluctuation is obviously recognized. The speed fluctuations of the photoreceptor drum 110 are shown in FIGS. 12(*c*-1) and 12(*c*-2). As can clearly be seen from FIG. 12(*c*-2), the speed fluctuation of the photoreceptor drum 110 is greatly decreased, as the result of the speed moderation of the motor M, to which the present invention has been applied.

The speed fluctuation moderation signal is a signal which is outputted from the control section immediately when the signals from the acceleration sensors S1 and S2 are inputted into the control section, or is outputted in a short time so that the speed is controlled after a predetermined period of time. For example, in a stepping motor, this signal controls the system so that a new driving pulse is added to, or subtracted from the driving pulses having a predetermined pitch, which are outputted during the image formation. In a DC motor, this signal controls the system so that the voltage of the power source for driving, which is constant during image formation, is increased or decreased for a short time.

A drive motor having an active control system is also controlled according to the speed fluctuation moderation signal. This active control is conducted as follows. A drive value, which has a phase opposite to the fluctuated value, and which can cancel the fluctuation, is added not only to the rotation status of the photoreceptor, that is, the fluctuation of the rotational speed of the photoreceptor, but also to the fluctuation of the rotation acceleration, the angular velocity, the angular acceleration, etc., and the fluctuation of rotation is controlled to be zero. However, strictly, it is necessary to compute a control value according to the detection signal during the period from the rotation fluctuation detection time to the time in which control is actually started, and a time lag occurs. Further, a mechanical time lag, mainly caused by the transmission of rotation by gears, etc., also occurs. In order to cope with these time lags, when the time lag of the system is already known, a program, in which the time lag is taken into account, is made. On the other hand, in a system in which the time lag is not known exactly, when rotation data, obtained at the time of detection of the rotation condition, is compared with data obtained before the detection of the rotation condition, the condition of the rotation fluctuation, that is, an increasing period or a decreasing period of the rotation fluctuation, is computed. Thereby, the value of the rotation fluctuation, at the actually controlled time, is predicted. When the predicted value is used as a control value, the control is actually conducted, or the acceleration, etc. of the fluctuation value is obtained, and a change in the speed is predicted and controlled.

Accordingly, the active control includes not only the case in which a value having the exactly reverse amplitude and an opposite phase, is added to the speed fluctuation of the photoreceptor, but also includes the case of a value having the smaller amplitude and having some phase shift. As an actual example, the following control is conducted in which a value, having an amplitude smaller than that of the speed fluctuation, and having an opposite phase which changes in steps, is added to the speed fluctuation which changes gently. The rotation detection means operates as follows. A row of bar-codes, having a predetermined intervals, is provided on the rotational body, integrally provided with the photoreceptor or the rotation shaft. These bar-codes are optically detected as a pulse signal, and the rotational information is obtained from the pulse signal by this rotation detection means. As a specific example of this rotation detection means, there is a rotary encoder, or the like. As the rotational information detected by the rotation detection means, there are provided the rotation acceleration, the angular velocity, the angular acceleration, the angle of the photoreceptor, the position information of a predetermined point provided on the peripheral surface of the photoreceptor, etc., in addition to the rotational speed of the photoreceptor. The rotation control system is composed of a rotation measurement system (behavior detection), a characteristic computing system (response determination), and a drive control system (drive pulse generation), and thereby, the drive control of the drive means (driver unit) is conducted.

FIG. 11 shows another example of the first embodiment of the present invention. The rotational member 118A of the transfer roller 118, and the holding member 221A of the cleaning blade 221 are respectively structured such that switches SW1 and SW2 can be respectively operated at the beginning of rotation of respective members. The pressure contact and the release from the pressure contact of the transfer roller 118 and the cleaning blade 221 are indirectly detected before their operations, and a signal of the pressure contact and the release from the pressure contact of the transfer roller 118 and the cleaning blade 221 is outputted to the control section 301A. Explanations of other structures are omitted because the explanation in FIG. 10 is applied to this embodiment without any change.

In the detection means of the pressure-contact and the release of the pressure-contact of the transfer unit and/or cleaning unit of the first embodiment, the following means other than examples shown in FIGS. 10 and 11 may be applied. For example, a detection circuit is provided by which an electrical connection of the transfer roller or the cleaning blade to the photoreceptor drum is detected, when the transfer roller or the cleaning blade comes into contact with the photoreceptor drum, and the pressure contact operation and the release operation from the pressure contact are detected by an electrical continuity signal.

Figure 13:
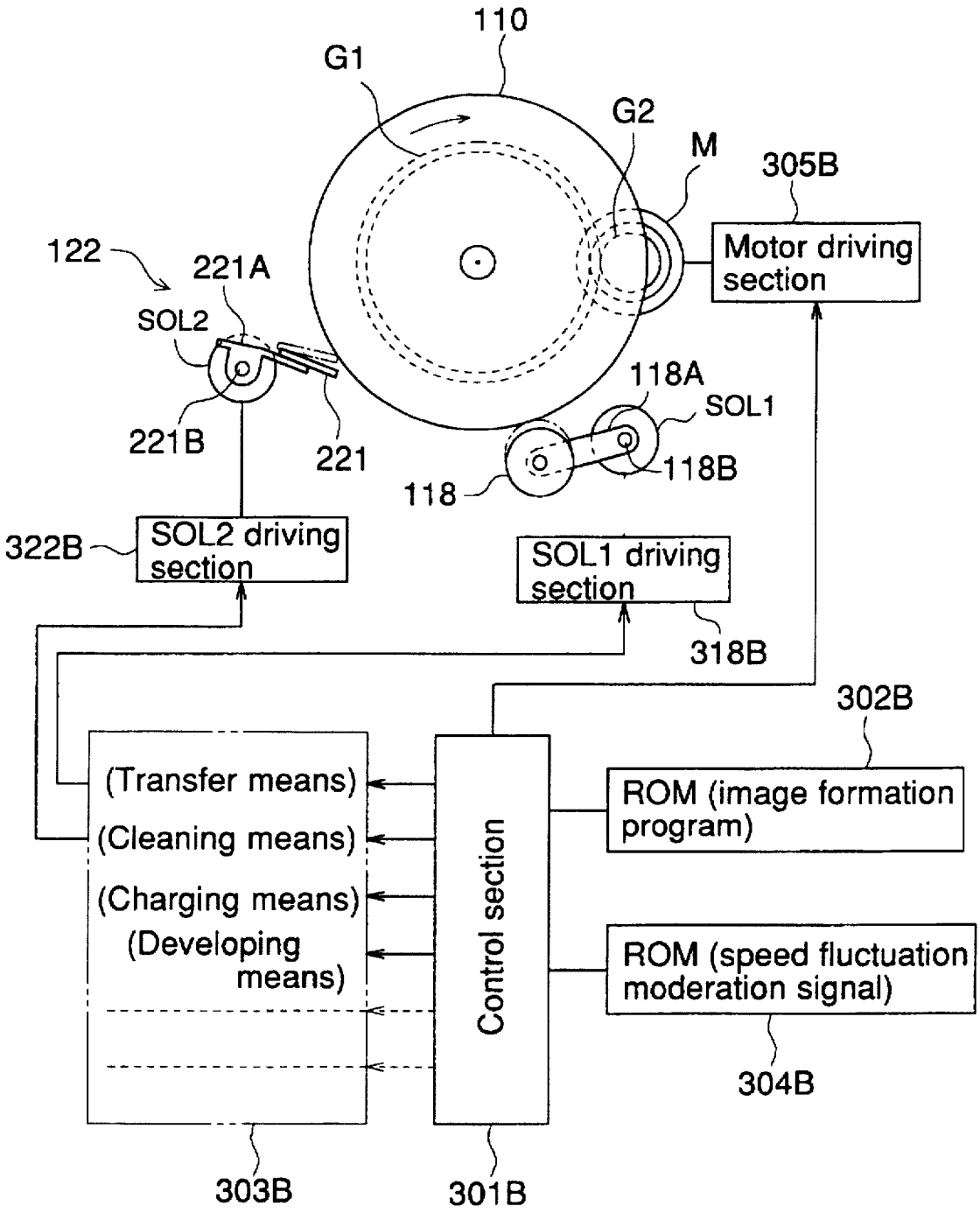
FIG. 13 is a view showing the structure of the second example of the present invention.

Referring to FIG. 13, an example of the second embodiment will be described below.

In FIG. 13, a control section 301B is a control section of the image forming apparatus shown in FIG. 9. An image is formed by an image formation means 303B including a scorotron charger 112, an image exposure means 113, developing units 114, a transfer roller 118, a cleaning unit 122, etc., according to a program read from the ROM 302B in which the image formation program is stored. Further, the photoreceptor drum 110 is operated as follows. The power transmission system is composed of the gear G1, fixed on the shaft of the photoreceptor drum, and the gear G2 of the drive motor M, engaged with the gear G1. The drive motor M is driven through the motor drive section 305B by a command from the control section 301B according to the image formation program, and the photoreceptor drum 110 is rotated clockwise.

The image forming apparatus of the present invention is structured as follows. When the control section 301B outputs the signal for the pressure contact and the release from the pressure contact of the transfer roller 118 with the photoreceptor drum 110, according to the image formation program, the control section 301B simultaneously reads a drive control program (speed fluctuation moderation signal) for the transfer roller, which is stored in advance in the ROM 304B, from the ROM 304B, and the control section 301B outputs the program to the motor drive section 305B. The pressure contact signal of the transfer roller 118, outputted from the image formation means 303B, is sent to a SOL1 drive section 318B, and the transfer roller 118 comes into pressure contact with the photoreceptor drum 110 when a rotary solenoid SOL1 is rotated clockwise. The speed fluctuation of the photoreceptor drum 110, caused by this pressure contact (load fluctuation), is controlled such that the fluctuation is cancelled by the speed fluctuation of the drive motor M according to the speed fluctuation moderation signal, outputted from the control section 301B simultaneously with the pressure control signal, and the speed of the photoreceptor drum 110 is stabilized.

This is the same as the cleaning unit. When the pressure contact signal and the pressure contact release signal of the cleaning blade 221 to the photoreceptor drum 110 is outputted from the control section 301B according to the image formation program, the speed fluctuation moderation signal for the cleaning unit, stored in the ROM 304B in advance, is read from the ROM 304B by the control section 301B, and is outputted to the motor drive section 305B. The speed fluctuation of the photoreceptor drum 110 caused by the pressure contact and the release from the pressure contact of the cleaning blade 221 to the photoreceptor drum 110, is cancelled by the speed fluctuation of the motor M according to the speed fluctuation moderation signal, and the speed of the photoreceptor drum 110 is controlled such that it will be stable and uniform.

A stepping motor, a DC motor, or a drive motor having an active control system, which are used in the above-described example 1, may be also used in this example as a drive motor. (Example 3)

In the above-described Examples 1 and 2, the speed fluctuation moderation signal, which is previously set, is stored in the respective ROMs 304A and 304B. The previously set speed fluctuation moderation signal is read from the respective ROMs and outputted to the respective motor drive sections 305A and 305B, according to the pressure contact motion or the release motion from the pressure contact of the transfer unit and/or the cleaning unit, or a pressure contact command or the pressure contact release command outputted from the respective control sections 301A and 301B. However, the load fluctuation at the time of pressure contact or pressure contact release changes due to extended periods of use of the apparatus. Accordingly, it is not appropriate that the drive motor is controlled for a long period of time by the same, previously set speed fluctuation moderation signal. In the example 3, which will be described below, the drive motor is controlled as follows. A speed fluctuation moderation signal, by which changes in the speed of the photoreceptor drum are reduced to the minimum, is selected from a plurality of drive control programs, corresponding to the load fluctuation at the time of pressure contact or pressure contact release, and the speed of the drive motor is controlled by the selected speed fluctuation moderation signal.

Figure 14:
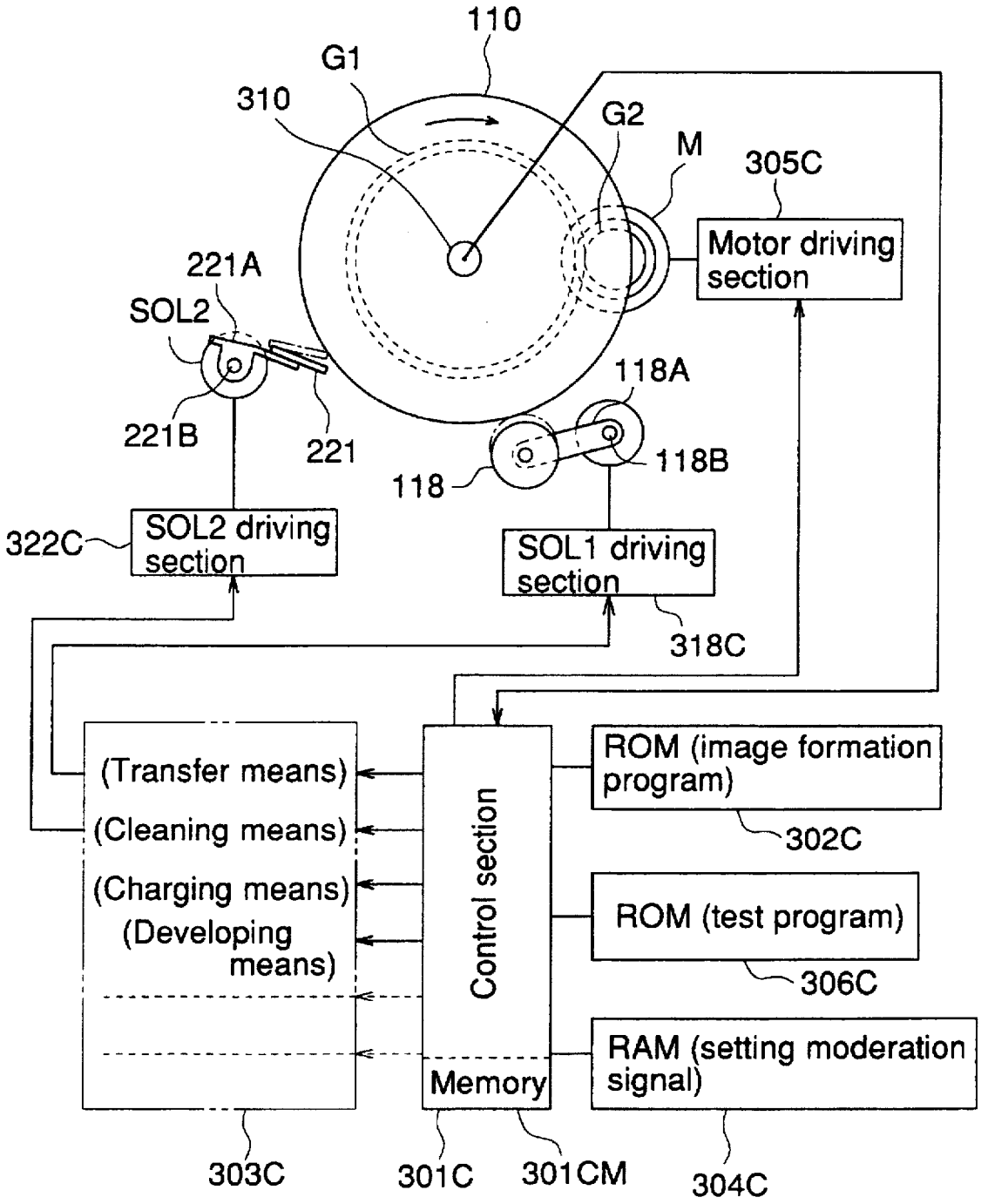
FIG. 14 is a view showing the structure of the third example of the present invention.

Referring to FIG. 14, the third example will be described. In this connection, the example shown in FIG. 14, is shown as the second embodiment, in which the speed fluctuation moderation signal is read, simultaneously with a command for the pressure contact or the pressure contact release of the transfer unit and/or the cleaning unit, outputted from the control section 301C, and then the signal is outputted to a motor drive section 305C. However, this example may be applied also to the first embodiment, in which the speed fluctuation moderation signal is read from from a memory according to the pressure contact or the pressure contact release motion of the transfer unit and/or the cleaning unit, and the signal is outputted to the motor drive section 305A. In this example, a ROM 302C in which the image formation program is stored, and a ROM 306C in which a test program is stored, are used as the memory.

The test program has a test operation program and a motor drive control program by which the amount of change in the drive speed of the drive motor and its time are determined.

Figure 15:
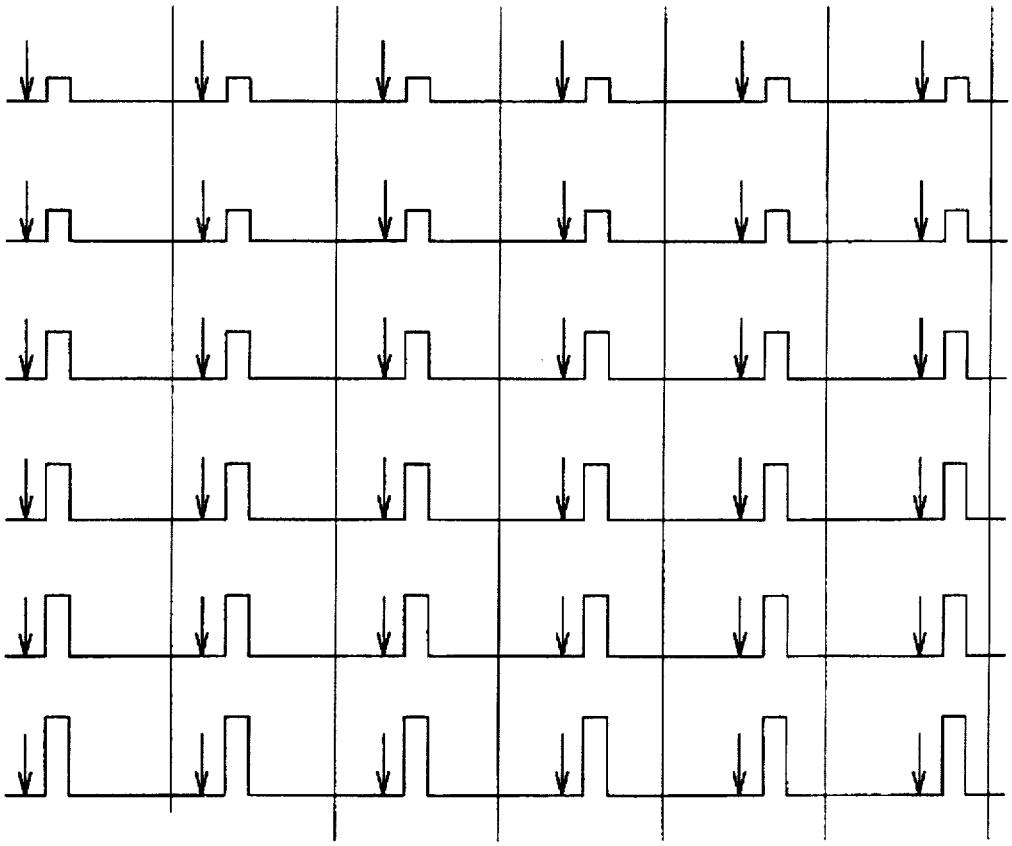
FIGS. 15(*a*) and 15(*b*) are views showing an example of a motor drive control table used in the third example.
Figure 15:
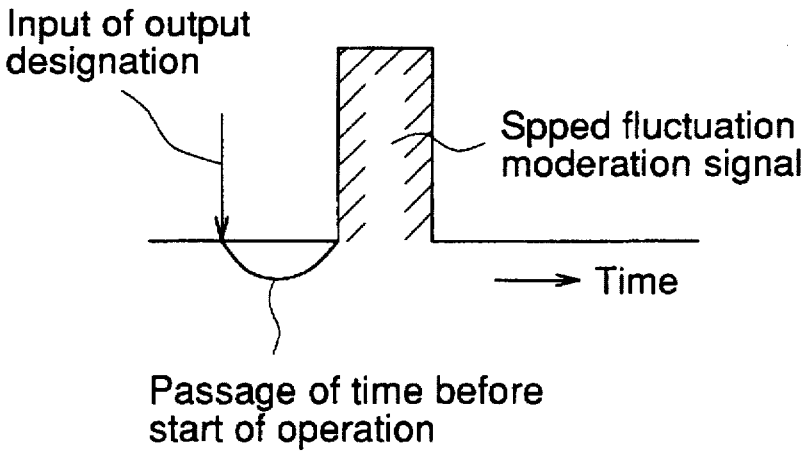

FIGS. 15(*a*) and 15(*b*) show a motor drive control table, which is actually a binarized table. FIG. 15(*a*) shows an example of the arrangement of the table. FIG. 15(*b*) shows one of the motor drive signals. In the motor drive control table shown in FIG. 15(*a*), a time, elapsed from the input of the output command shown by an arrow to the start of the motor speed fluctuation operation, is gradually changed, in the horizontal direction. In this drawing, signals are arranged such that the amplitude of the signal is the same as that of other signals. In the drawing, the time from the input of the output command to the start of the operation is the same as that of other signals, and the amplitude of the speed fluctuation moderation signal is gradually changed, in the vertical direction. Here, the speed fluctuation moderation signal accelerates the drive motor M clockwise or counterclockwise through the motor drive section 305C. Each motor drive signal has a specific number of (x, y), and a corresponding motor drive signal is outputted from the ROM 306C when the control section 301C calls for this specific number.

In the image forming apparatus in this example, as a speed fluctuation detection means of the photoreceptor drum 110, a bar-code row having a predetermined interval is provided on the shaft of the drum, and an encoder 310, by which this bar-code is optically received and detected as pulse signals, is attached on the shaft of the drum 110. The output from the encoder 310 is processed by an F-V converter, etc., in the processing process and the speed fluctuation of the photoreceptor drum 110 is digitized and inputted into the control section 301C. An acceleration sensor, a laser Doppler velocity fluctuation measuring apparatus, or the like, other than the encoder, may be used as the speed fluctuation detection means.

In the image forming apparatus of this example, a "test mode" can be set. When this test mode is set, the control section 301C calls for a test program from the ROM 306C, and the test is conducted according to this program. In this connection, the test mode can be automatically set and the test is conducted, for example, when 10,000 copy cycles have been completed. Further, the test mode can also be manually set by service personnel, and the test is conducted. When the test mode is set, the control section 301C outputs a command according to the test program, and the photoreceptor drum 110 is rotated at a predetermined speed by the drive motor M. Next, the pressure contact signal or the pressure contact release signal of the transfer roller 118 is outputted from the control section. When a rotary solenoid SOL1 is rotated through a SOL1 drive section 318C, the transfer roller 118 comes into pressure contact with the photoreceptor drum 110, or it is released from the pressure contact with the photoreceptor drum 110. The control section 301C reads the digitized speed fluctuation (A) of the photoreceptor drum 110, at the time of the pressure contact or the pressure contact release, from the encoder 310 and stores it in a memory 301CM, simultaneously with the output of the pressure contact signal or the pressure contact release signal from the control section C. Next, the control section C calls for a motor drive signal (speed fluctuation moderation signal) from the motor drive control table in the ROM 306C by a previously prepared specific number (B), and outputs it to the motor drive section 305C, simultaneously with the output of the signal for pressure contact or pressure contact release of the transfer roller 118. Then, the control section 301C reads the speed fluctuation (B), at the time of the pressure contact or the pressure contact release, from the encoder 310, and it is checked whether the speed fluctuation (B), read as above, is within a predetermined limit value (an allowable speed fluctuation range). When the speed fluctuation is larger than the limit value, the speed fluctuation (B) is also stored in the memory 301CM, and the speed fluctuation (A) is compared with the speed fluctuation (B). According to the result of this comparison, a specific number, to be sequentially called for from the motor drive control table, is determined, and this test is repeated.

That is, the pressure contact signal and the pressure contact release signal of the transfer roller 118 are outputted from the control section 301C. The control section 301C calls for the motor drive signal (speed fluctuation moderation signal) from the motor drive control table in the ROM 306C by the specific number (C), and outputs it to the motor drive section 305C. Then, the control section 301C reads the speed fluctuation (C), at the time of the pressure contact or at the time of pressure contact release, from the encoder 310. It is checked whether the speed fluctuation (C), read as described above, is within a predetermined limit value or not. When the result of this comparison is larger than the limit value, the speed fluctuation (C) is also stored in the memory 301CM. Then, the speed fluctuation (C) is respectively compared with the speed fluctuation (A), and the speed fluctuation (B). According to this comparison, the specific number (D), to be sequentially called for from the motor drive control table, is determined in the form of feedback. Then, in the same way, this test is repeated.

In the case where the speed fluctuation (K), obtained when the motor drive signal (speed fluctuation moderation signal) is outputted according to the specific number (K), is within a predetermined limit value, by repeating the test according to the test program, the motor drive signal (speed fluctuation moderation signal) of the specific number (K) is stored in the RAM 304C as a setting moderation signal.

An optimum motor drive signal (speed fluctuation moderation signal) is determined, which is to be outputted from the control section 301C at the time of pressure contact of the transfer roller 118 with the photoreceptor drum 110, and at the time of pressure contact release of the transfer roller from the photoreceptor drum 110 of the transfer roller 118. This signal is stored in the RAM 304C. In the same way, in the case where the cleaning blade 221 comes into pressure contact with, or it is released from the pressure contact with the photoreceptor drum 110, the optimum motor drive signal (speed fluctuation moderation signal), which is to be outputted from the control section 301C at the time of pressure contact, or at the time of release from the pressure contact of the cleaning blade, is determined by the test program. This signal value is stored in the RAM 304C, and the drive motor M is stopped, and the test according to the test program is completed.

When the operation mode of the apparatus is switched to the image formation mode, the control section 301C reads the image formation program from the ROM 302C, and an image is formed. When the transfer roller 118 and/or the cleaning blade 221 come into pressure contact with the photoreceptor drum or these are released from the pressure contact with the photoreceptor drum, the corresponding setting moderation signal is read from the RAM 304C, and is outputted to the motor drive section 305C, simultaneously with the command for the pressure contact and the pressure contact release for controlling the drive motor M. Thus, the speed fluctuation of the photoreceptor drum 110 is constantly within an allowable range, and an image of high quality, having no pitch fluctuation, can be obtained.

In the image forming apparatus of this example, the control section 301C reads the digitized speed fluctuation, at the time of the pressure contact with and the pressure contact release from the photoreceptor drum 110, from the encoder 310 at any arbitrary time, for example, at each 1000 copy cycle. This digitized speed fluctuation is compared with a predetermined limit value (an allowable range of the speed fluctuation). The system may be structured such that the operation mode of the apparatus is automatically switched to the above-described test mode when the speed fluctuation, read as above, is larger than the limit value. In the case of this example, an image of high quality, having no pitch fluctuation, is constantly obtained, even when the apparatus is used for a long period of time, or under severe environmental conditions.

In the present invention, the image forming apparatus is structured as follows. In the image forming apparatus which comprises the transfer unit and cleaning unit, which come into pressure contact with, and are released from the pressure contact with the photoreceptor, the control section outputs the speed moderation signal so that the drive motor is controlled, at the time when the operation for the pressure contact and the pressure contact release is detected, or when a command for the pressure contact and the pressure contact release, is outputted. Accordingly, the rotational speed fluctuation of the photoreceptor is greatly reduced, and an image of high quality, having no pitch fluctuation, can be obtained.

The drive unit of the photoreceptor for attaining the fourth object of the present invention actively controls the drive speed of the drive motor of the color image forming apparatus, described in the examples 1 through 3.

Figure 16:
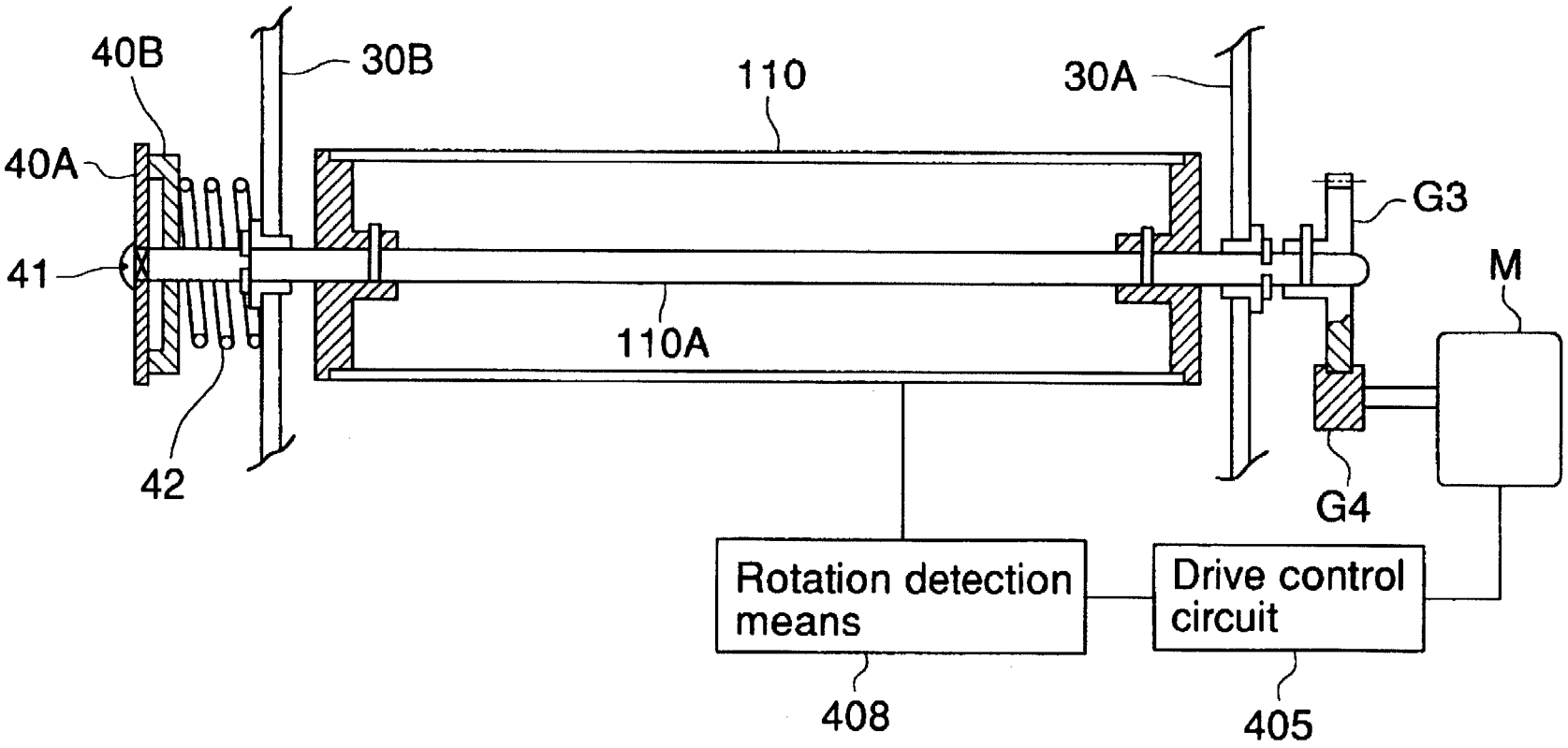
FIG. 16 is a view showing the structure of a driving apparatus of the photoreceptor of the present invention.

The photoreceptor drum 110, shown in FIG. 9, is structured as follows. As shown in FIG. 16, a shaft of the photoreceptor drum 110A is rotatably supported between base plates 30A and 30B. A gear G3 is provided on the end of the shaft, protruding from the base plate 30A provided on the rear side of the apparatus. When a gear G4, engaged with the gear G3, of the motor M is rotated, the photoreceptor drum 110 is rotated in the predetermined direction.

A bar-code row, each bar of which has a predetermined interval, is provided, for example, on the surface of the drum 110 or on the surface of the shaft of the photoreceptor drum 110. Accordingly, rotation information of the rotational speed or rotation acceleration is optically detected as a pulse signal by a rotation detection means 408, such as an optical means using a rotary encoder, etc. The pulse signal detected by the rotation detection means 408 is sent to a drive control circuit 405. In the drive control circuit 405, the frequency of the electric power source of the motor M is changed by more than several Hz, and thereby, the drive speed of the motor M is controlled corresponding to the rotation information, so that the rotational speed of the photoreceptor drum 110 is constantly maintained constant. In this connection, in order to cope with a time lag from the detection of the fluctuation of the rotational speed of the photoreceptor drum 110 to the start of the control of the drive speed of the motor M, a control program, in which the time lag is taken into account in advance, is stored in the apparatus.

On the other hand, a disk-shaped friction plate 40A is affixed with a screw member 41 integrally on a coaxial basis on the end of the shaft, protruding from the base plate 30B, on the front side of the apparatus.

Further, on the outer surface of the base plate 30B, a circular friction member 40B is supported so that it can slide in the direction of the shaft. The friction member 40B is brought into pressure contact with the friction plate 40A by the elasticity of a compression coil spring 42 provided between this friction plate 40A and the base plate 30B.

The compression coil spring 42 is formed so that its winding direction is equal to the direction of the rotation of the photoreceptor drum 110, and both ends of the spring are respectively in pressure contact with the base plate 30B and the friction plate 40B. Accordingly, when the photoreceptor drum 110 is rotated, the friction force is generated in the direction of the rotation between the friction plate 40A and the friction member 40B, by the elasticity of the compression coil spring in the axial direction, and the rotational operation of the friction plate 40A is controlled. Thereby, a predetermined load torque T is applied onto the photoreceptor drum 110.

The value of the load torque T is set in order to prevent that the response of the control is delayed by a backlash existing between the gear G3 and the gear G4 when the rotational speed of the photoreceptor drum 110 or the drive speed of the motor M is accelerated or decelerated, resulting in inappropriate control. Accordingly, the rotational force of the motor M, to be actively controlled, is transmitted without any time lag, and without any error due to the backlash, resulting in appropriate control of the rotational speed of the photoreceptor drum 110.

In order to transmit the drive force while the gear G3 is constantly being in contact with the corresponding surface of the gear G4, it is necessary to satisfy the following relational expression, when the acceleration, which can be applied to the photoreceptor drum 110 by braking, is defined as β', the acceleration to decrease the speed of the photoreceptor drum, is defined as β, and the moment inertia of the photoreceptor drum 110 is defined as I, $$|\beta'|=T/I>|\beta|$$

That is, in order to prevent the separation of the tooth flank of the gear G3 from that of the gear G4 when the speed is decreased, it is necessary that the absolute value of the acceleration β', which can be applied to the photoreceptor by braking, is larger than that of the acceleration β to decrease the speed of the photoreceptor drum.

Accordingly, the following equation is obtained, $$T \geqq |I \cdot \beta| \quad (1)$$

The value of I can be set at the time of the design. The optimum value of β is determined so that the rotational speed of the photoreceptor is controlled to be a desired value, and this value is different depending on the number of natural frequency, the level of load fluctuations to be applied to the photoreceptor, or the like.

In this example, the following experiment was carried out. The acceleration β to decrease the speed of three types of photoreceptor drums 110, which have the same outer shape but have different moment of inertia I, were respectively changed, and the controlability for each rotational speed was evaluated. The result is shown in Table 1.

That is, in this example, the controlability at the time when the load fluctuation is applied to the photoreceptor and the control is carried out so that the speed fluctuation is stabilized, was compared with each other. In this case, the values of β of three types of photoreceptors were determined, and the controlability, when the braking torque was changed, was judged. In this case, four levels of braking torque, i.e., the braking torque T, obtained by the above relational expression of |I·β|, T/2, 1.5×T, and 2×T, were judged, and the controlability is respectively shown by marks ○, Δ, X. The criterion of evaluation is determined as follows. A mark ○ is corresponding to "generally good", Δ is corresponding to "slightly delayed", and X is corresponding to "unstable" or "diversed".

TABLE 1

| Type of photoreceptor | | A | B | C |
|---|---|---|---|---|
| I (× $10^{-4}$ kgf · m · $S^2$) | | 3 | 2 | 1.5 |
| β (rad/$s^2$) | | 100 | 120 | 140 |
| T = I × β (kgf · cm) | | 3 | 2.4 | 2.1 |
| Controllability | T/2.0 | Δ | X | X |
| | T | ○ | ○ | Δ |
| | T × 1.5 | ○ | ○ | ○ |
| | T × 2 | ○ | ○ | ○ |

Figure 17:
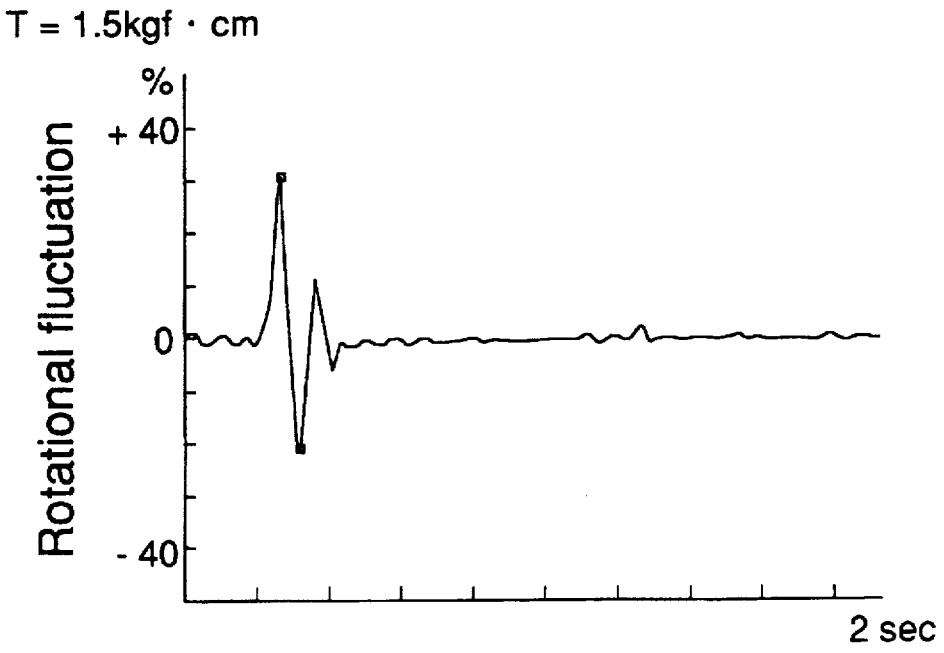
FIGS. 17(*a*) and 17(*b*) are graphs showing the status of generation of rotational fluctuations of the photoreceptor according to the present invention.
Figure 17:
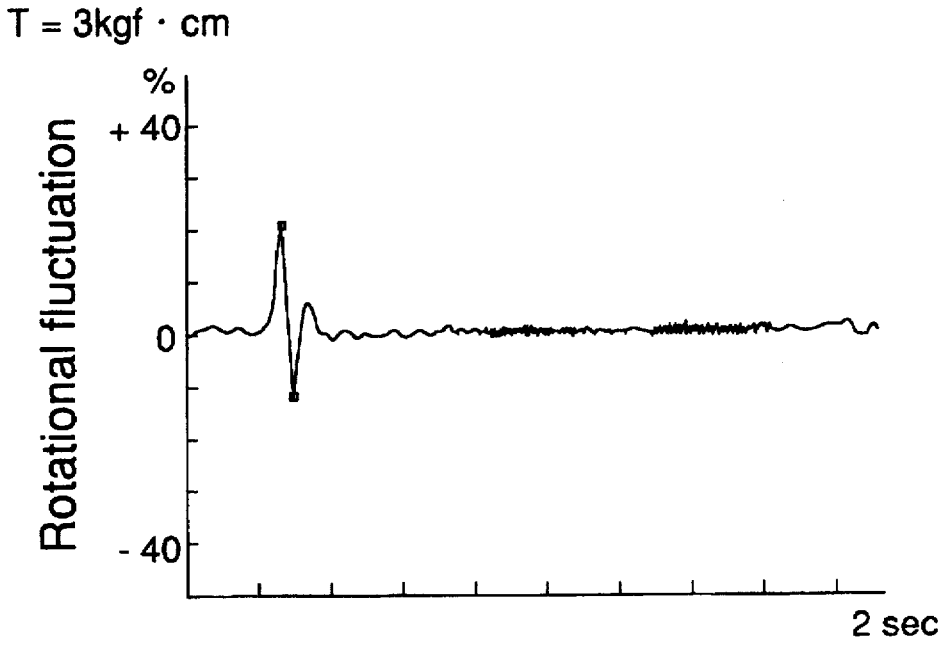

In the case of the photoreceptor A, when the torque T is set to 3 kgf·cm or more, which is obtained by the relational expression (1), the controlability of the rotational speed of the photoreceptor is satisfactory. However, when the torque T is set to T/2, the controlability is insufficient, and the rotational speed can not be appropriately controlled. FIGS. 17(*a*) and 17(*b*) respectively show the amplitude of the rotation fluctuation of the photoreceptor A and its condition of attenuation. In the drawings, when the torque T is set to 1.5 kgf·cm, the amplitude of the rotation fluctuation is larger and the attenuation time is longer as shown in FIG. 17(*a*). However, when the torque is set to 3 kgf·cm, since the response is quicker when the drive speed of the motor M is increased or decreased, the amplitude of the rotation fluctuation is relatively smaller, and the attenuation time is shorter.

Concerning the photoreceptor B and the photoreceptor C, the following is also recognized. When the torque T is set to more than the value obtained by the relational expression (1), the satisfactory controlability can be obtained.

In this connection, when the drive speed of the motor M is not actively controlled, the amplitude of the rotation fluctuation of the photoreceptor and its attenuation time are, respectively, much larger and longer, as shown in FIGS. 18(*a*) and 18(*b*), even when the torque T is applied to the photoreceptor. Accordingly, it is relatively difficult to obtain the stable rotational speed.

According to the present invention, when a braking device, by which the torque is applied to the photoreceptor, is provided to the photoreceptor, the photoreceptor, rotated by a motor which is actively controlled, is constantly driven at a predetermined rotational speed without being affected by the load fluctuation applied during image formation. As a result, the driving apparatus for the photoreceptor can be provided, by which a toner image, having the higher reproducibility from the original image and no pitch fluctuation, is formed.

What is claimed is:

1. An image forming apparatus comprising:

(a) a rotational photoreceptor for forming an image thereon;

(b) a driving system for driving the photoreceptor;

(c) a transfer device for transferring the image formed on the photoreceptor onto a recording sheet;

(d) a cleaning device for cleaning a residual toner image of the photoreceptor, wherein at least one of the transfer device and the cleaning device is in pressure contact with and released from the photoreceptor;

(e) control means for controlling the driving system, wherein the control means includes a predetermined drive control program for controlling the driving system so as to control a rotation speed of the photoreceptor, and said control means controls the driving system on the basis of said predetermined control program by taking into account a time lag of a motion of one of the transfer device and the cleaning device.

2. The apparatus of claim 1 further comprising:

a motor for driving the photoreceptor to rotate;

a transmitting system for transmitting a rotation of the motor to the photoreceptor; and an operation control unit for controlling operation of at least one of the transfer device and the cleaning device to come in pressure contact with and to be released from the photoreceptor, said operation control unit outputting a control signal, wherein said control means controls a rotation speed of the motor on the basis of the predetermined drive control program according to the control signal output by the operation control unit.

3. The apparatus of claim 1, wherein the drive control program includes means for controlling an amount of change in the rotation speed and a rotation period of time of the motor so that the rotation speed of the photoreceptor is maintained at a constant speed by one of accelerating or decelerating the motor with respect to the control signal.

4. The apparatus of claim 1 further comprising:

a rotation state detecting means for detecting a rotation state of the photoreceptor;

said control means including a plurality of predetermined drive control programs each for determining an amount of change in the rotation speed and a rotation period of time of the motor;

wherein one of said predetermined drive control programs in which a rotation speed change of the photoreceptor is minimized is selected from the plurality of predetermined drive control programs, and wherein a feed-back program indicating a selected drive control program is set as a drive control program during an image formation operation.

5. The apparatus of claim 1, wherein the control means includes means for actively controlling a drive speed of the motor so that a rotation state of the photoreceptor is detected, and a change of the rotation speed of the photoreceptor is canceled.

6. The apparatus of claim 1 further comprising:

a motor for driving the photoreceptor to rotate;

a transmitting system for transmitting a rotation of the motor to the photoreceptor; and a detector for detecting an operation of at least one of the transfer device and the cleaning device to come in pressure contact with and to be released from the photoreceptor, and for outputting a detection signal responsive thereto, wherein said controller controls a rotation speed of the motor on the basis of the predetermined drive control program according to the signal output by the detector.

7. The apparatus of claim 6, wherein the drive control program includes means for controlling an amount of change in the rotation speed and a rotation period of time of the motor so that the rotation speed of the photoreceptor is maintained at a constant speed by one of accelerating or decelerating the motor just after the detection signal is output by the detector.

8. The apparatus of claim 6 further comprising:

a rotation state detecting means for detecting a rotation state of the photoreceptor;

said control means including a plurality of predetermined drive control programs each for determining an amount of change in the rotation speed and a rotation period of time of the motor;

wherein one of said predetermined drive control programs in which a rotation speed change of the photoreceptor is minimized is selected from the plurality of predetermined drive control programs and wherein a feed-back program indicating a selected drive control program is set as a drive control program during an image formation operation.

9. The apparatus of claim 6, wherein the control means includes means for actively controlling a drive speed of the motor so that a rotation state of the photoreceptor is detected, and a change of the rotation speed of the photoreceptor is canceled.

10. The image forming apparatus of claim 1 further comprising a brake device for directly providing a load torque to one of the photoreceptor and a member integrally rotating with the photoreceptor.

11. An image forming apparatus comprising:

(a) a rotational photoreceptor for forming an image thereon;

(b) a driving system for driving the photoreceptor;

(c) a rotational body having a rotation shaft common to a rotation shaft of the photoreceptor for integral rotation therewith;

(d) marks provided on one of a circumferential surface and a side surface of one of the rotational body and the rotational photoreceptor, said marks being provided at a predetermined positional interval from each other and satisfying the following conditional expression, $$T=L\times 1/M$$

where T represents a cycle between two adjacent marks, L represents a length of entire pixels, and M represents a magnification ratio of an image formation lens;

(e) a light source for emitting light onto the marks;

(f) said image formation lens focusing the light reflected from the marks onto a line sensor;

(g) said line sensor having a plurality of pixels in a row, wherein each pixel outputs a first electric signal, and then, after a prescribed-period of time, each pixel outputs a second electric signal, in accordance with a light intensity of the light reflected from the marks through the image formation lens;

(h) detecting means for comparing the first electric signal with the second electric signal, and for detecting rotational information with respect to the photoreceptor according to the comparison; and (i) control means for controlling the driving system on the basis of the detected rotational information so as to control a rotation of the photoreceptor.

12. The apparatus of claim 11, further comprising means for converting the electric signals output by each pixel of the line sensor into a multiple-valued digital signal having more than two digits, and wherein the detecting means detects the digital signal.

13. The apparatus of claim 11, wherein the marks, the image formation lens and the line sensor are arranged so that a length of a projected image of the marks focused onto the line sensor is more than one cycle of the marks.

14. The apparatus of claim 11 further comprising:

an acceleration sensor provided on the photoreceptor, for generating electric signals having values different from each other, according to at least one of a rotating acceleration and a rotating speed of the photoreceptor; and control means for controlling the driving system on the basis of the electrical signals generated by the acceleration sensor.

15. The apparatus of claim 14, wherein the acceleration sensor comprises a piezoelectric element.

16. The apparatus of claim 15, wherein a direction of detection of the piezoelectric element is directed to a rotation direction of the photoreceptor.

17. The apparatus of claim 15, wherein a direction of detection of the piezoelectric element is directed to a direction of a concentric circle of the photoreceptor.

18. The apparatus of claim 14, wherein the acceleration sensor comprises a gyroscope.

19. The image forming apparatus of claim 14 further comprising a brake device for directly providing a load torque to one of the photoreceptor and a member integrally rotating with the photoreceptor.

20. The image forming apparatus of claim 11 further comprising a brake device for directly providing a load torque to one of the photoreceptor and a member integrally rotating with the photoreceptor.

21. An image forming apparatus comprising:

(a) a rotational photoreceptor for forming an image thereon;

(b) a driving system for driving the photoreceptor;

(c) detecting means for detecting rotational information with respect to the photoreceptor;

(d) control means for controlling the driving system on the basis of the detected rotational information so as to control a rotation of the photoreceptor;

(e) a rotational body having a rotation shaft common to a rotation shaft of the photoreceptor for integral rotation therewith, a circumferential surface of the rotational body being provided with marks at a predetermined positional interval from each other;

(f) a light source for emitting light onto the marks;

(g) a line sensor having a plurality of pixels in a row, wherein each pixel outputs an electric signal in accordance with a sensed light intensity;

(h) an image formation lens for focusing light reflected from the marks onto the plurality of pixels of the line sensor; and (i) means for converting the electric signal output by each pixel of the line sensor into a multiple-valued digital signal having more than two digits, wherein said detecting means detects the rotational information with respect to the photoreceptor on the basis of the digital signal.

22. The apparatus of claim 21, wherein the marks, the image formation lens and the line sensor are arranged so that a length of a projected image of the marks focused onto the line sensor is more than one cycle of the marks.

23. An image forming apparatus comprising:

(a) a rotational photoreceptor for forming an image thereon;

(b) a driving system for driving the photoreceptor;

(c) detecting means for detecting rotational information with respect to the photoreceptor;

(d) control means for controlling the driving system on the basis of the detected rotational information so as to control a rotation of the photoreceptor; and (e) an acceleration sensor provided on the photoreceptor for generating electric signals having values different from each other, according to at least one of a rotating acceleration and a rotating speed of the photoreceptor;

wherein said control means controls the driving system on the basis of the electrical signals generated by the acceleration sensor, and wherein said acceleration sensor comprises a piezoelectric element.

24. The apparatus of claim 23, wherein a direction of detection of the piezoelectric element is directed to a rotation direction of the photoreceptor.

25. The apparatus of claim 23, wherein a direction of detection of the piezoelectric element is directed to a direction of a concentric circle of the photoreceptor.

26. An image forming apparatus comprising:

(a) a rotational photoreceptor for forming an image thereon;

(b) a driving system for driving the photoreceptor;

(c) detecting means for detecting rotational information with respect to the photoreceptor;

(d) control means for controlling the driving system on the basis of the detected rotational information so as to control a rotation of the photoreceptor; and (e) an acceleration sensor provided on the photoreceptor for generating electric signals having values different from each other, according to at least one of a rotating acceleration and a rotating speed of the photoreceptor;

wherein said control means controls the driving system on the basis of the electrical signals generated by the acceleration sensor, and wherein said acceleration sensor comprises a gyroscope.

* * * * *